US006297688B1

(12) United States Patent
Nakamura

(10) Patent No.: US 6,297,688 B1
(45) Date of Patent: Oct. 2, 2001

(54) CURRENT GENERATING CIRCUIT

(75) Inventor: Hiroshi Nakamura, Kawasaki (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/385,639

(22) Filed: Aug. 27, 1999

(30) Foreign Application Priority Data

Aug. 28, 1998 (JP) ..... 10-243613

(51) Int. Cl.[7] ..... G05F 1/10; G05F 3/02
(52) U.S. Cl. ..... 327/538; 327/543
(58) Field of Search ..... 327/538, 543, 327/103; 323/313, 314, 315

(56) References Cited

U.S. PATENT DOCUMENTS 5,394,026 * 2/1995 Yu et al. ..... 327/536
5,500,774 * 3/1996 Watanabe et al. ..... 360/46
5,519,310 * 5/1996 Bartlett ..... 323/316
5,933,051 * 8/1999 Tsuchida et al. ..... 327/534
6,028,640 * 2/2000 Nayechi et al. ..... 348/525
6,075,407 * 6/2000 Doyle ..... 327/539

FOREIGN PATENT DOCUMENTS 10-233657 9/1998 (JP) .

* cited by examiner

*Primary Examiner*—Terry D. Cunningham
*Assistant Examiner*—Quan Tra
(74) *Attorney, Agent, or Firm*—Banner & Witcoff, Ltd.

(57) ABSTRACT

MOS transistor P01 is connected between the supply terminal Vcc and node a. Resistor R1 is connected between the node a and the grounding terminal GND. MOS transistor P03 is used to reduce the consumed current when the circuit is not in operation. Differential amplifier cmp1 compares the potential in01 of the node a and reference potential Vref and applies a control signal to the gate of the MOS transistor so as to make the potential in01 of the node a equal to the reference potential Vref. At the same time, the control signal is also applied to the gate of MOS transistor P02. The MOS transistor P02 generates an electric current as a function of the electric current flowing to the MOS transistor P01.

58 Claims, 18 Drawing Sheets

FIG. 24
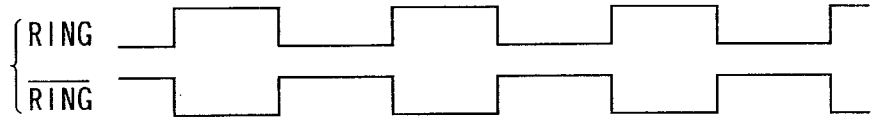
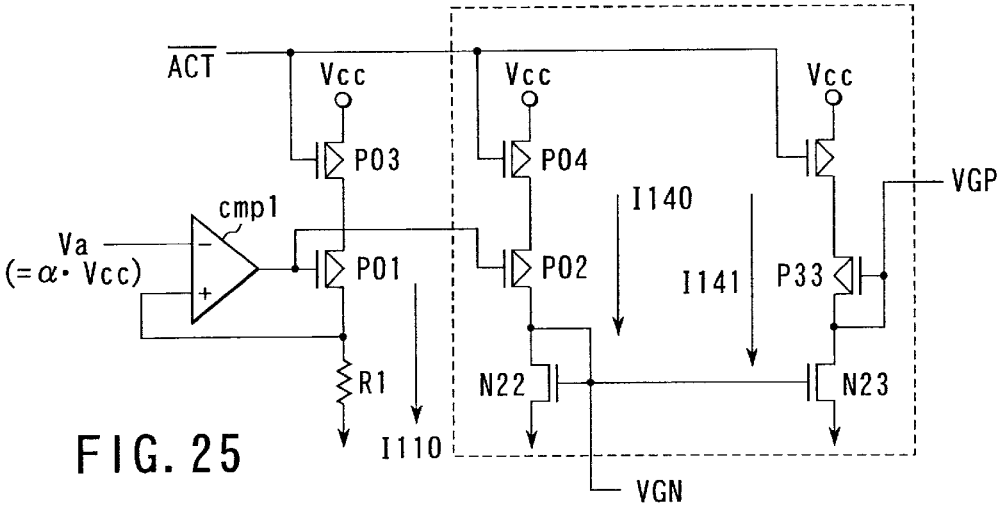
FIG. 25
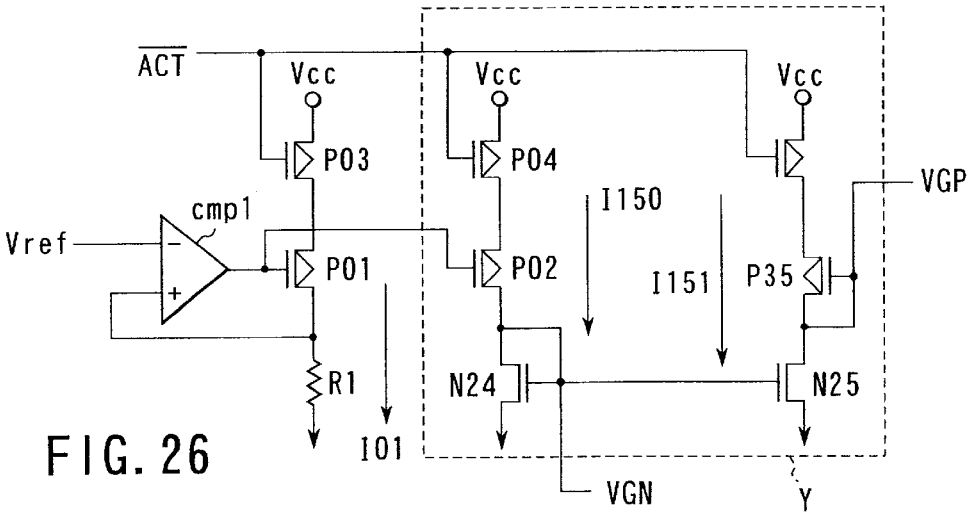
FIG. 26

FIG. 32
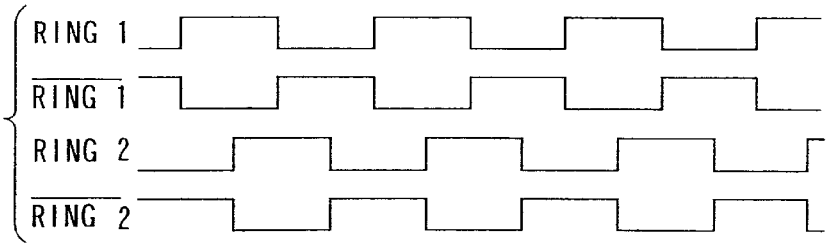
FIG. 33
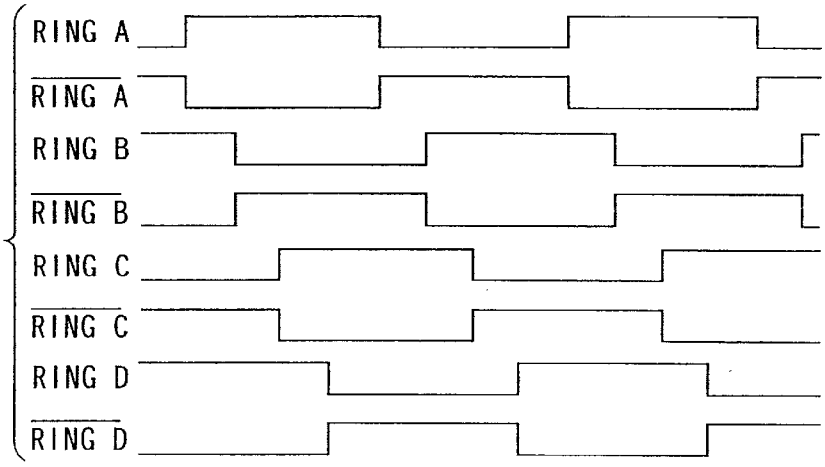
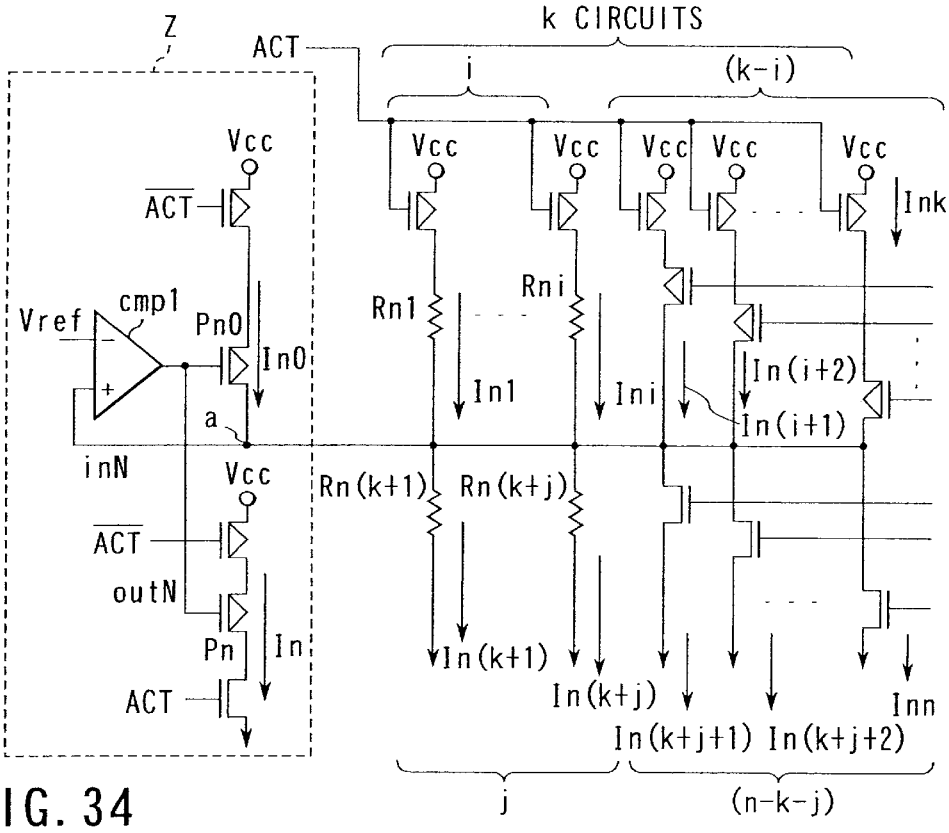
FIG. 34

CURRENT GENERATING CIRCUIT

BACKGROUND OF THE INVENTION

This invention relates to a current generating circuit applicable to an integrated circuit such as a semiconductor memory and also to an oscillator comprising such a current generating circuit.

FIG. 23 of the accompanying drawings schematically illustrates an oscillator of the type under consideration.

When the oscillator is operated, signal OSC is held to the supply potential Vcc and signal VGP is held to the ground potential (0V), while signal VGN is also held to supply potential Vcc.

Referring to FIG. 23, the delay time of an inverter circuit normally becomes reduced as the supply potential Vcc increases. Besides, the current level required for charging and discharging capacitors C1 and C2 increases at a rate greater than the first power of the supply potential Vcc as the latter also increases.

Thus, the oscillation period Tosc of the oscillator is shortened as the supply potential Vcc rises.

Therefore, when the oscillator is used as a timer, the oscillation period Tosc of the oscillator is reduced as the supply potential Vcc rises so that consequently the operating time of the timer is curtailed to reduce the margin of the operating timne of the timer for the operation of the chip because the oscillator period Tosc relies on the supply potential Vcc. To date, chips of the type under consideration are accompanied by the problem that the supply potential Vcc of the chip is confined to a narrowly limited range.

Now, let's look into a case where an output signal of the oscillator of FIG. 23 is used as drive signals RING, /RING for a booster as illustrated in FIG. 27.

Signal /OSC is held to the groun d potential (0V) when the booster is operated, whereas it is held to the supply potential Vcc when the booster is not operated. Note that, in FIG. 27, Qd1 denotes a depression type N-channel MOS transistor and Qn denotes an enhancement type N-channel MOS transistor.

The booster produces a potential higher than the supply potential Vcc on the basis of the supply potential Vcc and the drive signals RING, /RING, which potential is then output as output signal Vout. Generally speaking, the output current Iout of the booster is linearly proportional to Vcc—Vthn (where Vthn is a threshold value of the MOS transistor Qn) and inversely proportional to the oscillation period Tosc of the drive signals RING, /RING.

The output current Iout and the consumed current Icc of the booster can be expressed by specific formulas shown, employing the number of units n of the booster (which corresponds to the number of capacitors or that of inverters in FIG. 27);

$$Iout=k26\times(Vcc-Vthn)/Tosc \quad (15\text{-}1)$$

and $$Icc=k27\times(n+1)\times(Vcc-Vthn)\ Tosc \quad (15\text{-}2),$$

where k26 and k27 are constants independent of the supply potential Vcc).

For the chip to operate in a stable manner, it is desirable that both the output current Iout and the consumed current Icc depend little on the supply potential Vcc.

However, when the output signal of the oscillator of FIG. 23 whose oscillation period relies on the supply potential Vcc is used as a drive signal of the booster of FIG. 27, the output current Iout and the consumed current Icc of the booster of FIG. 27 increases at a rate greater than the first power of the supply potential Vcc if the latter also increases. Thus, it is not possible to realize an output current Iout and a consumed current Icc that are stable relative to fluctuations in the supply potential Vcc.

As discussed above, there are known only oscillators whose oscillation period becomes curtailed as the supply potential Vcc rises. Thus, the output current Iout and the consumed current Icc of a booster using an output signal of such an oscillator inevitably rely heavily on the supply potential Vcc so that consequently it is not possible for the booster to operate in a stable fashion relative to fluctuations in the supply potential Vcc.

BRIEF SUMMARY OF THE INVENTION

Therefore, it is the object of the present invention to provide a current generating circuit whose dependency on the supply potential can be varied and also provide an integrated circuit that comprises such a current generating circuit and is little dependent on the supply potential so that it may operate in a stable fashion regardless of fluctuations in the supply potential.

According to a first aspect of the invention, there is provided a current generating circuit comprising:

- a first transistor connected between a first supply terminal and a node directly or by way of another element;
- a total of k first elements ($0 \leqq k \leqq n$ (where n is 0 or a natural number)) connected between the first supply terminal and the node directly or by way of another element;
- a total of n−k second elements connected between the node and a second supply terminal directly or by way of another element;
- a control circuit for setting the potential of the node to a predetermined level; and
- a second transistor having its source connected to the first supply terminal directly or by way of another element and its gate connected to the gate of the first transistor and adapted to generate a second current by using a first current flowing to the first transistor as reference;
- the first current flowing to the first transistor showing a current value equal to the value obtained by subtracting the sum of the currents flowing to the respective k first elements from the sum of the currents flowing to the respective n−k second elements.

Preferably, a current flows to all of the first transistor, the k first elements and the n−k second elements when the current generating circuit is operated.

Preferably, both the k first elements and the n−k second elements comprise resistors or transistors.

According to the invention, there is also provided a current generating circuit comprising:

- a first transistor connected between a first supply terminal and a node directly or by way of another element;
- a first element connected between the first supply terminal and the node directly or by way of another element;
- a second element connected between the node and a second supply terminal directly or by way of another element;
- a control circuit for setting the potential of the node to a predetermined level; and
- a second transistor having its source connected to the first supply terminal directly or by way of another element and its gate connected to the gate of the first transistor and adapted to generate a second current by using a first current flowing to the first transistor as reference;

the first current flowing to the first transistor showing a current value equal to the value obtained by subtracting the current flowing to the first element from the current flowing to the second element.

According to the invention, there is also provided a current generating circuit comprising:

a first transistor connected between a first supply terminal and a node directly or by way of another element;

a plurality of first elements connected between the node and a second supply terminal directly or by way of another element;

a control circuit for setting the potential of the node to a predetermined level; and a second transistor having its source connected to the first supply terminal directly or by way of another element and its gate connected to the gate of the first transistor and adapted to generate a second current by using a first current flowing to the first transistor as reference;

the first current flowing to the first transistor showing a current value equal to the sum of the currents flowing respectively to the plurality of first elements.

According to a second aspect of the invention, there is provided a current generating circuit comprising:

a first transistor connected between a first supply terminal and a node directly or by way of another element;

a first element connected between the first supply terminal and the node directly or by way of another element;

a second element connected between the node and a second supply terminal directly or by way of another element;

a second transistor having its source connected to the first supply terminal directly or by way of another element and its gate connected to the gate of the first transistor and adapted to generate a second current by using a first current flowing to the first transistor as reference; and a differential amplifier adapted to compare the potential of the node and the reference potential and applying a control signal reflecting the outcome of the comparison to the gate of the first transistor and that of the second transistor.

Preferably, a current flows to all of the first transistor, the second transistor, the first element and the second element when the current generating circuit is operated.

Preferably, both the first element and the second element comprise resistors or transistors.

Preferably, the supply potential is applied to the first supply terminal while the ground potential is applied to the second supply terminal. Alternatively, the ground potential is applied to the first terminal while the supply potential is applied to the second supply terminal.

If the reference potential is expressed by Vref and the supply potential is expressed by Vcc and if a, b and c are respectively first, second and third constants, the second transistor generates a current expressed by formula:

$$(a \times Vref)+[b \times \{Vcc-c \times (Vref)\}].$$

If the reference potential is expressed by Vref, the supply potential is expressed by Vcc and the absolute value of the threshold value of a third transistor included in the k first elements or the n−k second elements is expressed by Vth and if a and b are respectively first and second constants, the second transistor generates a current expressed by formula:

$$(a \times Vref)+\{b \times (Vcc-Vth)\}.$$

According to a third aspect of the invention, the current flowing to the second transistor of a current generating circuit according to the invention is used to control the oscillation period of an oscillator. The output signal of the oscillator is used as drive signal for a booster.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 24 is a schematic illustration of the waveform of an output signal of the oscillator of FIG. 23.

FIG. 25 is a schematic circuit diagram of a circuit for generating a signal to be applied to the oscillator of FIG. 23.

FIG. 26 is a schematic circuit diagram of another circuit for generating a signal to be applied to the oscillator of FIG. 23.

FIG. 32 is a schematic illustration of the waveform of an output signal of the oscillator of FIG. 30.

FIG. 33 is a schematic illustration of the waveform of an output signal of the oscillator of FIG. 31.

FIG. 34 is a schematic circuit diagram of still another embodiment of current generating circuit according to the invention.

DETAILED DESCRIPTION OF THE INVENTION

Now, a current generating circuit according to the invention will be described by referring to the accompanying drawings.

Figure 1:
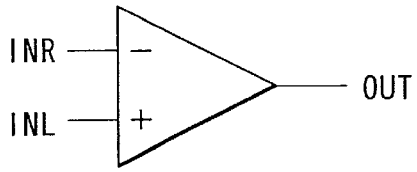
FIG. 1 is a schematic illustration of symbols that are normally used for a differential amplifier.
Figure 2:
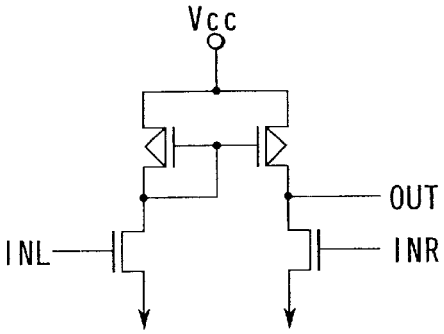
FIG. 2 is a schematic circuit diagram of a differential amplifier illustrated by using the symbols of FIG. 1.
Figure 3:
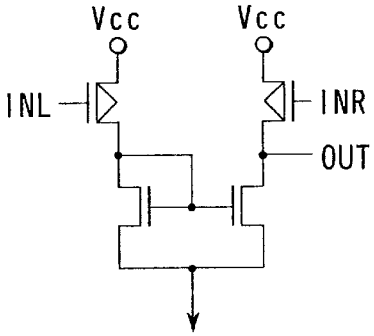
FIG. 3 is a schematic circuit diagram of another differential amplifier illustrated by using the symbols of FIG. 1.

FIG. 1 is a schematic illustration of symbols that are normally used for a differential amplifier and FIGS. 2 and 3 are schematic circuit diagrams of differential amplifiers illustrated by using the symbols of FIG. 1.

Both of the illustrated differential amplifiers comprise a pair of P-channel MOS transistors and a pair of N-channel MOS transistors and are adapted to receive input signals INR and INL at the gates of the P-channel MOS transistors of those of the N-channel MOS transistor respectively.

Figure 4:
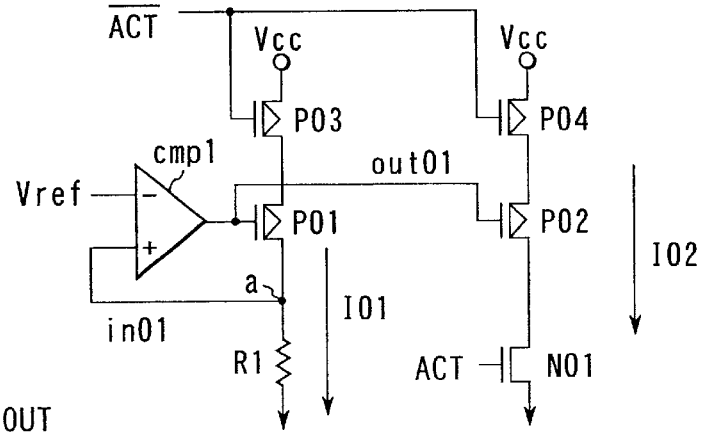
FIG. 4 is a schematic circuit diagram of an embodiment of current generating circuit according to the invention.

FIG. 4 is a schematic circuit diagram of an embodiment of a current generating circuit according to the invention and using a differential amplifier.

This circuit is a constant current generating circuit.

Referring to FIG. 4, P-channel MOS transistors P01, P03 and a resistor R1 are connected in series between the supply terminal and the grounding terminal. Similarly, P-channel MOS transistors P02, P04 and an N-channel MOS transistor N01 are connected in series between the supply terminal and the grounding terminal.

Reference potential Vref is applied to the negative side input terminal of the differential amplifier cmpl and the potential in01 of the connection node of the MOS transistor P01 and the resistor R1 is applied to the positive side input terminal of the differential amplifier cmp1. The output potential out01 of the differential amplifier cmp1 is applied to the gates of the MOS transistors P01, P02.

Signal ACT is input to the gate of the MOS transistor N01, whereas signal/ACT is input to the gats of the MOS transistors P03, P04.

Now, the operation principle of the above current generating circuit will be discussed.

Vref represents a reference potential, which is selected to be equal to a value between the supply potential Vcc and the grounding potential (0V). The reference potential Vref is held to a constant level (e.g., Vref=1.5V) if the supply potential Vcc fluctuates (e.g., Vcc=3V–3.6V).

When the circuit is operated, signal ACT is held to the supply potential Vcc, whereas signal/ACT is held to the grounding potential (0V). When, on the other hand, the circuit is not in operation, signal ACT is held to the grounding potential (0V), whereas signal ACT is held to the supply potential Vcc.

The transistors receiving the signal ACT or /ACT at the gate, or the P-channel MOS transistors P03, P04 and the N-channel MOS transistor N01, are arranged to reduce the consumed currents I01, I02.

Thus, the resistance of any of the MOS transistors P03, P04, N01 is lower than that of any of the remaining elements (the MOS transistors P01, P02 and the resistor R1) in operation.

Therefore, the currents I01, I02 of the current paths of the circuit are determined as a function of the resistance of each of the MOS transistors P01, P02 and the resistor R1.

In the current generating circuit, the condition of Vref=in01 is maintained by the differential amplifier in operation. Since the reference potential Vref is not dependent on the supply potential Vcc, the current I01 is expressed by the formula below.

$$I01=Vref/R1$$

Thus, the current I01 is also not dependent on the supply potential Vcc. Additionally, the output potential out01 of the differential amplifier is set to a level that makes the current flowing to the transistor P01 equal to I01.

Since the resistance of each of the MOS transistors P04, N01 is by far lower than that of the MOS transistor P02, the current I02 depends solely on the MOS transistor P02.

Thus, the current I02 is expressed by the formula below:

$$I02=k1\times I01=k1\times Vref/R1$$

where k1 is the current ratio of the MOS transistors P01, P02 whose gates are at a same potential level [=I(P02)/I(P01)] and hence can be set to a level not dependent on the supply potential.

Since both the source side (the supply potential Vcc side) nodes of the MOS transistors P01, P02 are at the supply potential Vcc and their gates are at a same potential, the currents flowing through the respective MOS transistors P01, P02 do not depend on their drain side potentials if the MOS transistors P01, P02 operate within the current range of a pentode (if the drain side potential Vd of each of the MOS transistors P01, P02 is lower than V(out01)+Vthp, provided that the potential of the out01 is V(out01) and the threshold voltage of the MOS transistors P01, P02 is −Vthp (Vthp>0)).

Therefore, k1 is not dependent on the supply potential Vcc and can be set to a level that is determined by ratio of the current drive capacities of the MOS transistors P01, P02 under a same condition (a condition where the potentials applied to the components of the MOS transistors P01, P02 are equal relative to each other). In other words, the current I02 is k1 times greater than the current I01.

Thus, with a current generating circuit having a configuration as described above, it is now possible to generate an output current that is not dependent on the supply potential Vcc.

Meanwhile, in the current generating circuit of FIG. 4, it is desirable that the MOS transistors P01, P02 having commonly shared gates show the same characteristics as transistors in order to make the current value I02 stable. This can be achieved by making the two MOS transistors P01, P02 show the same parameters including the channel length and minimizing variances in the characteristics between the MOS transistor P01, P02.

Figure 5:
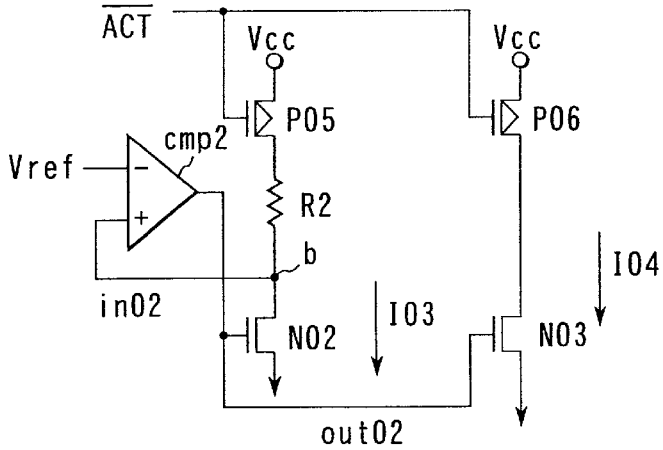
FIG. 5 is a schematic circuit diagram of another embodiment of current generating circuit according to the invention.

FIG. 5 is a schematic circuit diagram of another embodiment of a current generating circuit according to the invention and using a differential amplifier.

Referring to FIG. 5, a P-channel MOS transistor P05, an N-channel MOS transistor N02 and a resistor R2 are connected in series between the supply terminal and the grounding terminal. Similarly, a P-channel MOS transistor P06 and an N-channel MOS transistor N03 are connected in series between the supply terminal and the grounding terminal.

Reference potential Vref is applied to the negative side input terminal of the differential amplifier cmp2 and the potential in02 of the connection node of the MOS transistor N01 and the resistor R2 is applied to the positive side input terminal of the differential amplifier cmp2. The output potential out02 of the differential amplifier cmp2 is applied to the gates of the MOS transistors N02, N03.

Signal/ACT is input to the gates of the MOS transistors P05, P06.

Now, the operation principle of the above current generating circuit will be discussed.

Vref represents a reference potential, which is selected to be equal to a value between the supply potential Vcc And the grounding potential (0V). The reference potential Vref is held to a constant level (e.g., Vref=1.5V) if the supply potential Vcc fluctuates (e.g., Vcc=3V–3.6V).

When the circuit is operated, signal/ACT is held to the grounding potential (0V), whereas, when the circuit is not operated, signal/ACT is held to the supply potential Vcc.

The transistors receiving the signal/ACT at the gate, or the P-channel MOS transistors P05, P06 are arranged to reduce the consumed currents I03, I04.

Thus, the resistance of either of the MOS transistors P05, P06 is lower than that of any of the remaining elements (the MOS transistors N02, N03 and the resistor R2) in operation.

Therefore, the currents I03, I04 of the current paths of the circuit are determined as a function of the resistance of each of the MOS transistors N02, N03 and the resistor R2.

In the current generating circuit, the condition of Vref=in02 is maintained by the differential amplifier in operation. Thus, the current I03 is expressed by the formula below.

$$I03=(Vcc-Vref)$$

Since the output potential out02 of the differential amplifier is set to a level that makes the current flowing to the transistor N02 equal to I03, the current I04 is expressed by the formula below:

$$I04=k2\times I03=k2\times(Vcc-Vref)/R2$$

where k2 is the current ratio of the MOS transistors N02, N03 whose gates are at a same potential level [=I(N03)/I(N02)] and hence can be set to a level not dependent on the supply potential.

Thus, with a current generating circuit having a configuration as described above, it is now possible to generate an output current that is proportional to (Vcc−Vref).

Meanwhile, in the current generating circuit of FIG. 5, it is desirable that the MOS transistors N02, N03 having commonly shared gates show the same characteristics as transistors in order to make the current value I04 stable. This can be achieved by making the two MOS transistors N02, N03 show the same parameters including the channel length and minimizing variances in the characteristics between the MOS transistor N02, N03.

Figure 6:
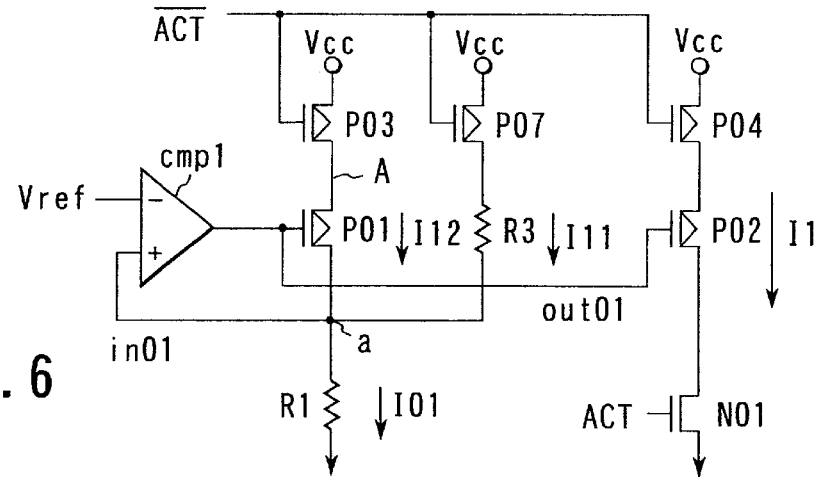
FIG. 6 is a schematic circuit diagram of a current generating circuit obtained by modifying that of FIG. 4.

FIG. 6 is a schematic circuit diagram of a current generating circuit obtained by modifying that of FIG. 4.

By comparing the current generating circuit with that of FIG. 4, it will be seen that the former differs from the latter only in that a P-channel MOS transistor P07 and a resistor R3 are additionally connected in series between the supply terminal and node a. Otherwise the configuration of the circuit is identical with that of the current generating circuit of FIG. 4. Note that signal /ACT is applied to the gate of the MOS transistor P07.

With this current generating circuit, the current value of each of the current paths of the circuit is determined by the elements to which neither of the signals ACT, /ACT is applied (the MOS transistors P01, P02 and the resistors R1, R3).

In the current generating circuit, the condition of Vref=in01 is maintained by the differential amplifier in operation. Thus, the currents I01, I11, I12 are expressed respectively by the formulas below.

$$I01=Vref/R1,$$

$$I11=(Vcc-Vref)/R3 \text{ and}$$

$$I12=I01-I11$$

$$=Vref/R1-(Vcc-Vref)/R3.$$

Therefore, current I1 is expressed by the formula below:

$$I1=k3\times I12$$

$$=k3\times\{Vref/R1-(Vcc-Vref)/R3\},$$

where k3 is the current ratio of the MOS transistors P01, P02 whose gates are at a same potential level [=I(P02)/I(P01)] and hence can be set to a level not dependent on the supply potential.

Thus, with a current generating circuit shown in FIG. 6 and having a configuration as described above, it is now possible to generate an output current that is proportional to {Vref/R1−(Vcc−Vref)/R3}.

Meanwhile, in the current generating circuit of FIG. 6, it is desirable that the MOS transistors P01, P02 having commonly shared gates show the same characteristics as transistors in order to make the current value I1 stable. This can be achieved by making the two MOS transistors P01, P02 show the same parameters including the channel length and minimizing variances in the characteristics between the MOS transistor P02, P03.

Figure 7:
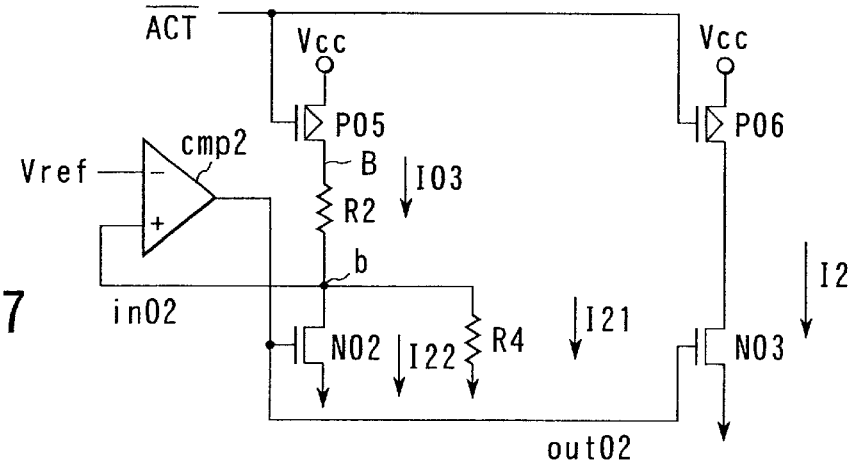
FIG. 7 is a schematic circuit diagram of a current generating circuit obtained by modifying that of FIG. 5.

FIG. 7 is a schematic circuit diagram of a current generating circuit obtained by modifying that of FIG. 5.

By comparing the current generating circuit with that of FIG. 5, it will be seen that the former differs from the latter only in that a resistor R4 is additionally connected between node b and the grounding terminal. Otherwise the configuration of the circuit is identical with that of the current generating circuit of FIG. 5.

With this current generating circuit again, the current value of each of the current paths of the circuit is determined by the elements to which no signal /ACT is applied (the MOS transistors N02, N03 and the resistors R2, R4).

In the current generating circuit, the condition of Vref=in02 is maintained by the differential amplifier in operation. Thus, the currents I03, I21, I22 are expressed respectively by the formulas below.

$$I03=(Vcc-Vref)/R2,$$

$$I21=Vref/R4 \text{ and}$$

$$I22=I03-I21$$

$$=\{(Vcc-Vref)/R2-Vref/R4\}.$$

Therefore, current I2 is expressed by the formula below:

$$I2=k4\times I22$$

$$=k4\times\{(Vcc-Vref)/R1-Vref/R4\},$$

where k4 is the current ratio of the MOS transistors N02, N03 whose gates are at a same potential level [=I(N03)/I(N02)] and hence can be set to a level not dependent on the supply potential.

Thus, with a current generating circuit shown in FIG. 7 and having a configuration as described above, it is now possible to generate an output current that is proportional to {(Vcc−Vref)/R2−Vref/R4}.

Meanwhile, in the current generating circuit of FIG. 7, it is desirable that the MOS transistors N02, N03 having commonly shared gates show the same characteristics as transistors in order to make the current value I2 stable. This can be achieved by making the two MOS transistors N02, N03 show the same parameters including the channel length and minimizing variances in the characteristics between the MOS transistor N02, N03.

Figure 8:
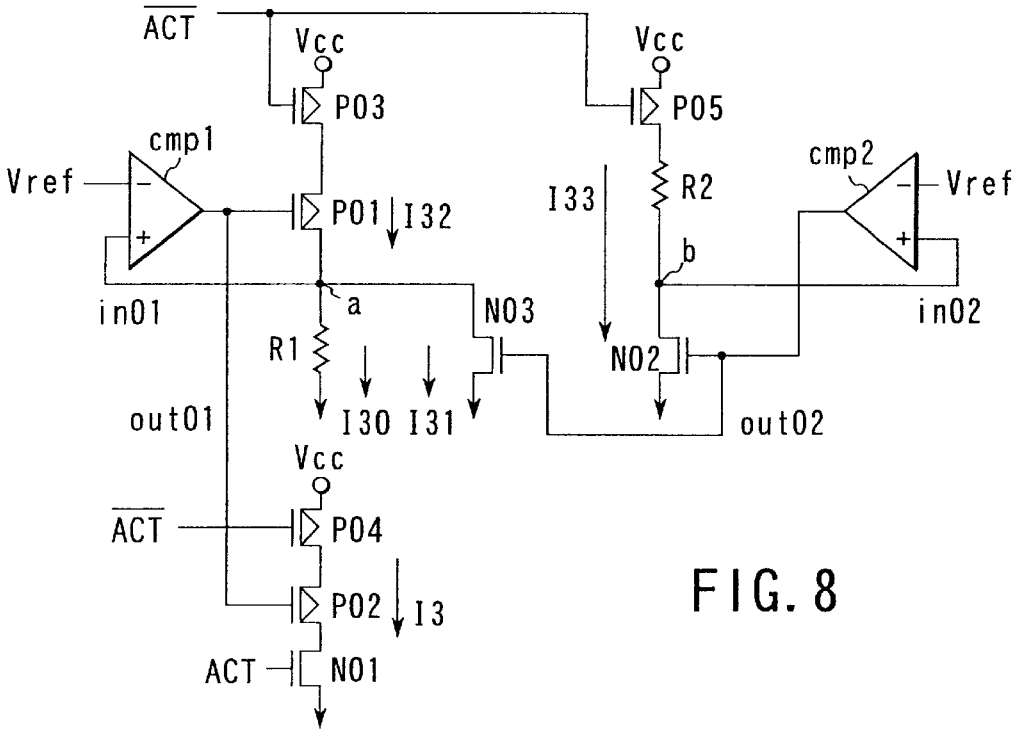
FIG. 8 is a schematic circuit diagram of a still another embodiment of current generating circuit according to the invention.

FIG. 8 is a schematic circuit diagram of a current generating circuit according to the invention and having two differential amplifiers.

This current generating circuit is realized by combining a current generating circuit as shown in FIG. 4 and a current generating circuit as shown in FIG. 5. Therefore, the elements corresponding to those of FIGS. 4 and 5 are denoted by the same reference symbols.

With this current generating circuit again, the current value of each of the current paths of the circuit is determined by the elements to which neither of the signals ACT, /ACT is applied (the MOS transistors P01, P02, N02, N03 and the resistors R1, R2).

In the current generating circuit, the condition of Vref=in01=in02 is maintained by the differential amplifiers in operation. Thus, the currents I30, I33 are expressed respectively by the formulas below.

$$I30=Vref/R1 \text{ and}$$

$$I33=(Vcc-Vref)/R2.$$

Since the current I31 is expressed by the formula below:

$$I31=k5\times I33=k5\times(Vcc-Vref)/R2$$

where k5 is the current ratio of the MOS transistors N02, N03 whose gates are at a same potential level [=I(N03)/I(N02)] and hence can be set to a level not dependent on the supply potential, the current I32 is expressed by the formula below:

$$I32=I30+I31$$

$$=Vref/R1+K5\times(Vcc-Vref)/R2.$$

Therefore, the current I3 is expressed by the formula below:

$$I3=k6\times I32$$

$$=k6\times\{Vref/R1+k5\times(Vcc-Vref)/R2\},$$

where k6 is the current ratio of the MOS transistors P01, P02 whose gates are at a same potential level [=I(P02)/I(P01)] and hence can be set to a level not dependent on the supply potential.

Thus, with a current generating circuit shown in FIG. 8 and having a configuration as described above, it is now possible to generate an output current that is proportional to (Vcc−Vref).

Meanwhile, in the current generating circuit of FIG. 8, it is desirable that the MOS transistors P01, P02 having commonly shared gates show the same characteristics as transistors and, similarly, the MOS transistors N02, N03 having commonly shared gates also show the same characteristics as transistors in order to make the current value I3 stable.

Figure 9:
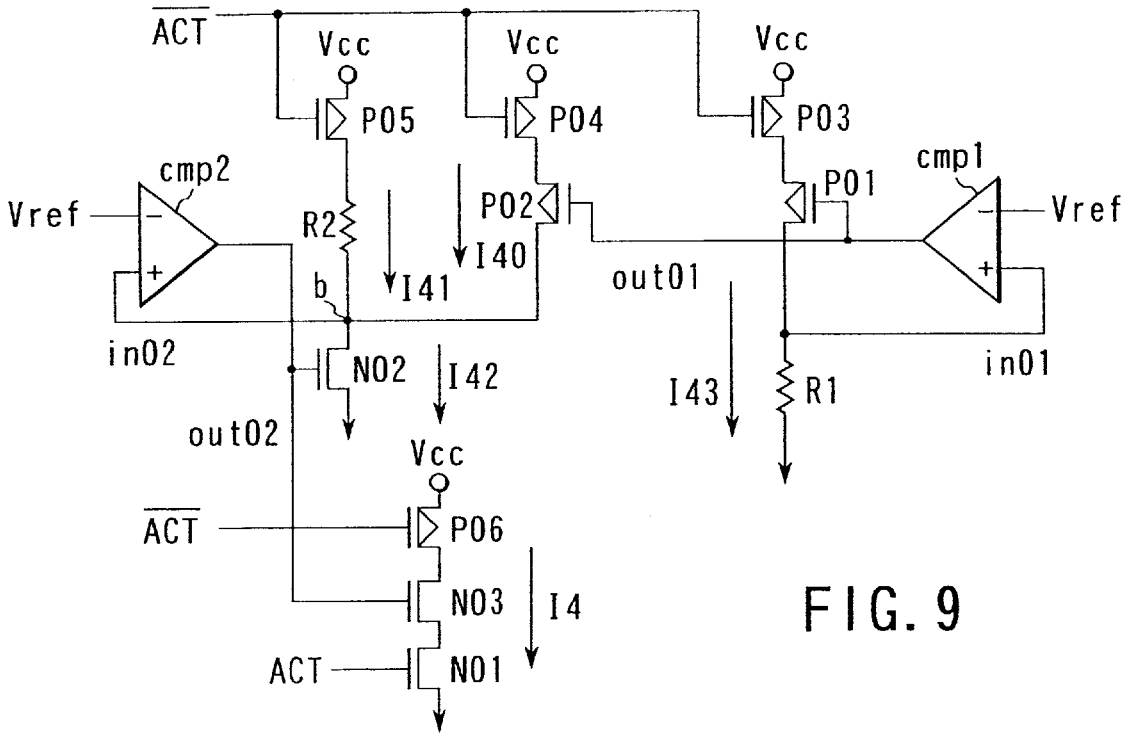
FIG. 9 is a schematic circuit diagram of still another embodiment of current generating circuit according to the invention.

FIG. 9 is a schematic circuit diagram of another current generating circuit according to the invention and having two differential amplifiers.

This current generating circuit is also realized by combining a current generating circuit as shown in FIG. 4 and a current generating circuit as shown in FIG. 5. Therefore, the elements corresponding to those of FIGS. 4 and 5 are denoted by the same reference symbols.

With this current generating circuit again, the current value of each of the current paths of the circuit is determined by the elements to which neither of the signals ACT, /ACT is applied (the MOS transistors P01, P02, N02, N03 and the resistors R1, R2).

In the current generating circuit, the condition of Vref=in01=in02 is maintained by the differential amplifiers in operation. Since, the currents I41, I43, I40 are expressed respectively by the formulas below.

$$I41=(Vcc-Vref)/R2,$$

$$I43=Vref/R1 \text{ and}$$

$$I40=k7\times I43=k7\times Vref/R1,$$

where k7 is the current ratio of the MOS transistors P01, P02 whose gates are at a same potential level [=I(PO1)/I(P02)] and hence can be set to a level not dependent on the supply potential, the current I42 is expressed by the formula below:

$$I42=I40+I41$$

$$=k7\times Vref/R1+(Vcc-Vref)/R2.$$

Therefore, the current I4 is expressed by the formula below:

$$I4=k8\times I42$$

$$=k8\times\{k7\times Vref/R1+(Vcc-Vref)/R2\},$$

where k8 is the current ratio of the MOS transistors N02, N03 whose gates are at a same potential level [=I(N02/I(N03))] and hence can be set to a level not dependent on the supply potential.

Thus, with a current generating circuit shown in FIG. 9 and having a configuration as described above, it is now possible to generate an output current that is expressed by the formula above in terms of supply potential Vcc.

Meanwhile, in the current generating circuit of FIG. 9 it is desirable that the MOS transistors P01, P02 having commonly shared gates show the same characteristics as transistors and, similarly, the MOS transistors N02, N03 having commonly shared gates also show the same characteristics as transistors in order to make the current value I4 stable.

Figure 10:
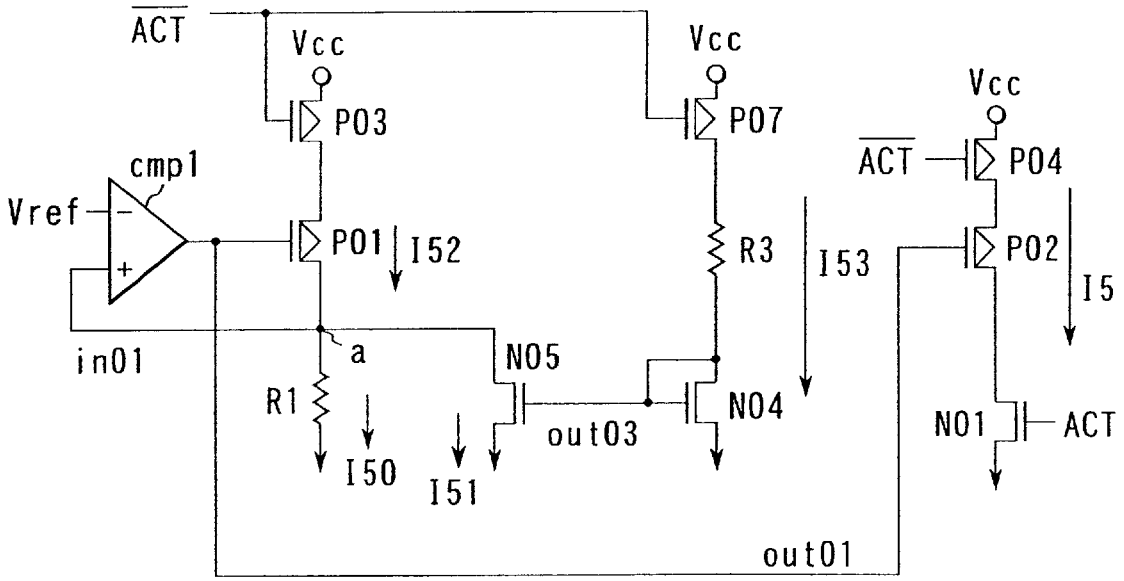
FIG. 10 is a schematic circuit diagram of a still another embodiment of current generating circuit according to the invention.

FIG. 10 is a schematic circuit diagram of another current generating circuit according to the invention and realized by diode connection (mutual connection of the gate and the drain).

This current generating circuit is realized on the basis of a current generating circuit as shown in FIG. 4. Therefore, the elements corresponding to those of FIG. 4 are denoted by the same reference symbols.

With this current generating circuit again, the current value of each of the current paths of the circuit is determined by the elements to which neither of the signals ACT, /ACT is applied (the MOS transistors P01, P02, N04, N05 and the resistors R1, R3).

In the current generating circuit, the condition of Vref=in01 is maintained by the differential amplifier in operation. Thus, the currents I50 is expressed respectively by the formulas below.

$$I50=Vref/R1$$

If the threshold value of the N-channel MOS transistor N04 (the gate potential out03 when the current value is equal to I53) is Vthn04, a relationship of out03=Vthn04 can be set. Therefore, the current I53 is expressed by the formula below.

$$I53=(Vcc-Vthn04)/R4$$

Since the current I51 is expressed by the formula below:

$$I51=k9\times I53=k9\times(Vcc-Vthn04)/R3,$$

where k9 is the current ratio of the MOS transistors N04, N05 whose gates are at a same potential level [=I(N04)/I(N05))] and hence can be set to a level not dependent on the supply potential, the current I52 is expressed by the formula below:

$$I52=I50+I51$$

$$=Vref/R1+k9\times(Vcc-Vthn04)/R3.$$

Therefore, the current I5 is expressed by the formula below:

$$I5=k10\times I52$$

$$=k10\times\{Vref/R1+k9\times(Vcc-Vthn04)/R3\},$$

where k10 is the current ratio of the MOS transistors P01, P02 whose gates are at a same potential level [=I(P01)/I(P02)] and hence can be set to a level not dependent on the supply potential.

Thus, with a current generating circuit shown in FIG. 10 and having a configuration as described above, it is now possible to generate an output current that is expressed by the formula above in terms of supply potential Vcc.

Meanwhile, in the current generating circuit of FIG. 10 it is desirable that the MOS transistors P01, P02 having commonly shared gates show the same characteristics as transistors and, similarly, the MOS transistors N04, N05 having commonly shared gates also show the same characteristics as transistors in order to make the current value I5 stable.

Figure 11:
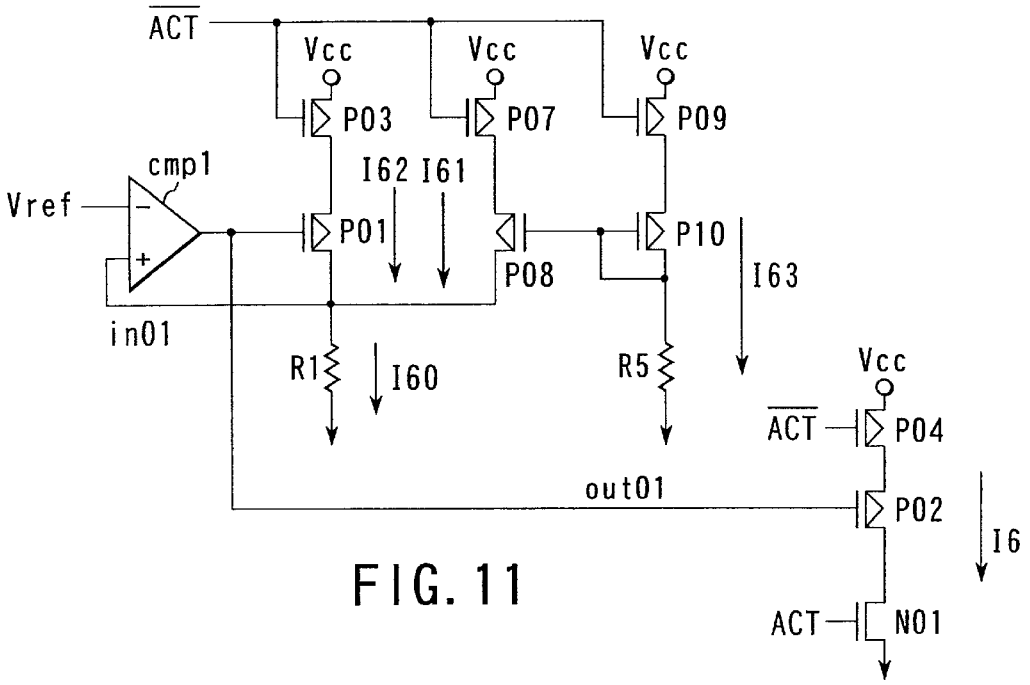
FIG. 11 is a schematic circuit diagram of still another embodiment of a current generating circuit according to the invention.

FIG. 11 is a schematic circuit diagram of another current generating circuit according to the invention and realized by diode connection (mutual connection of the gate and the drain).

This current generating circuit is realized on the basis of a current generating circuit as shown in FIG. 4. Therefore, the elements corresponding to those of FIG. 4 are denoted by the same reference symbols.

With this current generating circuit again, the current value of each of the current paths of the circuit is determined by the elements to which neither of the signals ACT, /ACT is applied (the MOS transistors P01, P02, P08, P10 and the resistors R1, R5).

In the current generating circuit, the condition of Vref=in01 is maintained by the differential amplifier in operation. Thus, the currents I60 is expressed respectively by the formulas below.

$$I60=Vref/R1=$$

If the threshold value of the P-channel MOS transistor P10 (the differential between the power source potential Vcc and the gate potential out04 when the current value is equal to I63) is −Vthp10 (Vthp10>0), a relationship of out04=Vcc−Vthp10 can be set. Therefore, the current I63 is expressed by the formula below.

$$I63=(Vcc-Vthp10)/R5$$

Since the gates of the MOS transistors P08, P10 are held to a same potential level, the current I61 is expressed by the formula below:

$$I60=k11\times I63$$

$$=k11\times(Vcc-Vthp10)/R5,$$

where k11 is the current ratio of the MOS transistors P08, P10 whose gates are at a same potential level [=I(P08)/I(P10)] and hence can be set to a level not dependent on the supply potential. Then, the current I62 is expressed by the formula below:

$$I62=I60+I61$$

$$=Vref/R1+k11\times(Vcc-Vthp10)/R5.$$

Therefore, the current I6 is expressed by the formula below:

$$I6=k12\times I62$$

$$=k12\times\{Vref/R1-k11\times(Vcc-Vthp10)/R5\},$$

where k12 is the current ratio of the MOS transistors P01, P02 whose gates are at a same potential level [=I(P01)/I(P02)] and hence can be set to a level not dependent on the supply potential.

Thus, with a current generating circuit shown in FIG. 11 and having a configuration as described above, it is now possible to generate an output current that is expressed by the formula above in terms of supply potential Vcc.

Meanwhile, in the current generating circuit of FIG. 11 it is desirable that the MOS transistors P01, P02 having commonly shared gates show the same characteristics as transistors and, similarly, the MOS transistors P08, P10 having commonly shared gates also show the same characteristics as transistors in order to make the current value I6 stable.

Figure 12:
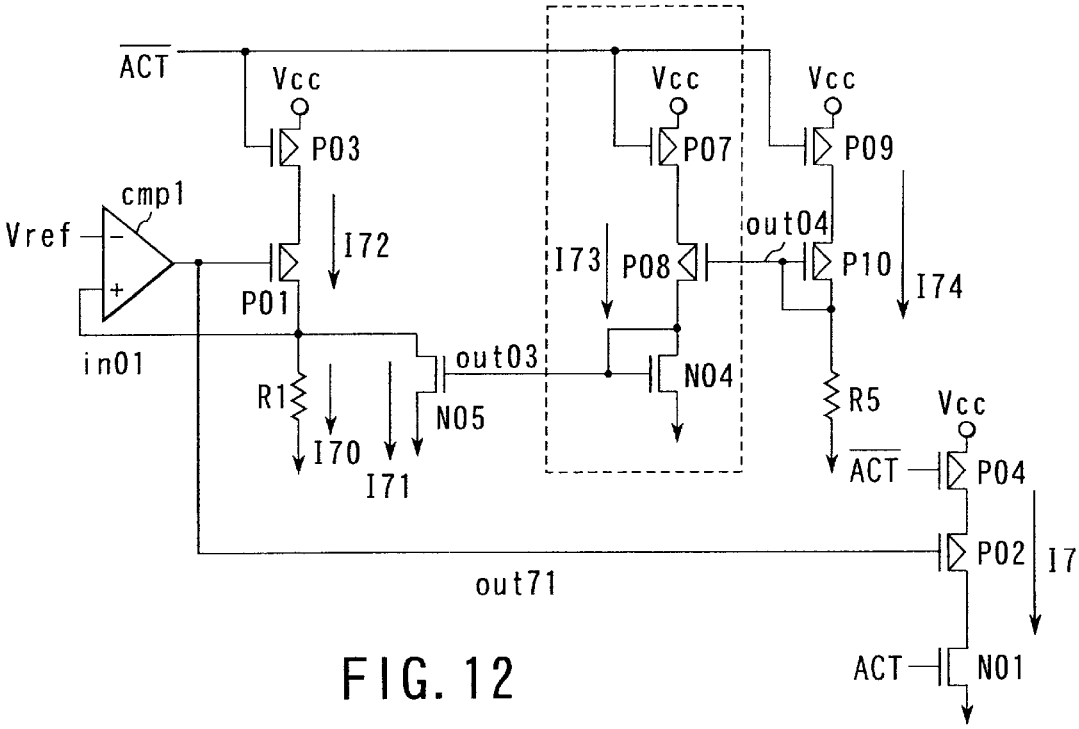
FIG. 12 is a schematic circuit diagram of still another embodiment of a current generating circuit according to the invention.

FIG. 12 is a schematic circuit diagram of another current generating circuit according to the invention and realized by diode connection (mutual connection of the gate and the drain).

This current generating circuit is realized by combining a current generating circuit as shown in FIG. 10 and a current generating circuit as shown in FIG. 11. Therefore, the elements corresponding to those of FIGS. 10 and 11 are denoted by the same reference symbols.

With this current generating circuit again, the current value of each of the current paths of the circuit is determined by the elements to which neither of the signals ACT, /ACT is applied (the MOS transistors P01, P02, P08, P10, N04, N05 and the resistors R1, R5).

In the current generating circuit, the condition of Vref=in01 is maintained by the differential amplifiers in operation. Thus, the currents I70 is expressed respectively by the formulas below.

$$I70=Vref/R1$$

If the threshold value of the P-channel MOS transistor P10 (the difference between the gate potential out04 and the supply potential Vcc when the current value is equal to I74) is −Vthp10 (Vthp10>0), a relationship of out04=Vcc−Vthp10 can be set. Therefore, the current I74 is expressed by the formula below.

$$I74=(Vcc-Vthp10)/R5$$

Additionally, since the gates of the MOS transistors P08, P10 are held to a same potential level, the current I73 is expressed by the formula below:

$$I73=k13\times I74$$

$$=k13\times(Vcc-Vthp10)/R5,$$

where k13 is the current ratio of the MOS transistors P08, P10 whose gates are at a same potential level [=I(P08)/I(P10)] and hence can be set to a level not dependent on the supply potential.

If the threshold value of the N-channel MOS transistor N04 (the gate potential out03 when the current value is equal to I73) is Vthn04, a relationship of out03=Vthn04 can be set.

Additionally, since the gates of the MOS transistors N04, N05 are held to a same potential level, the current I71 is expressed by the formula below:

$$I71=k14\times I73$$

$$=k14\times k13\times(Vcc-Vthp10)/R5,$$

where k14 is the current ratio of the MOS transistors N04, N05 whose gates are at a same potential level [=I(N04)/I(NO5)] and hence can be set to a level not dependent on the supply potential. Thus, the current I72 is expressed by the formula below:

$$I72=I70+I71$$

$$=Vref/R1+k14\times k13\times(Vcc-Vthp10)/R5.$$

Therefore, the current I7 is expressed by the formula below:

$$I7=k15\times I72$$

$$=k15\times\{Vref/R1+k14\times k13\times(Vcc-Vthp10)/R5\},$$

where k15 is the current ratio of the MOS transistors P01, P02 whose gates are at a same potential level [=I(P01)/I(P02)] and hence can be set to a level not dependent on the supply potential.

Thus, with a current generating circuit shown in FIG. 12 and having a configuration as described above, it is now possible to generate an output current that is expressed by the formula above in terms of supply potential Vcc.

Meanwhile, in the current generating circuit of FIG. 12 it is desirable that the MOS transistors P01, P02 having commonly shared gates show the same characteristics as transistors and, similarly, the MOS transistors N04, N05 having commonly shared gates also show the same characteristics as transistors in order to make the current value I6 stable.

In the case of the current generating circuit of FIG. 12, a current can be made to flow to the N-channel MOS transistor N04 on the basis of the current generated by the P-channel MOS transistor P10 and the resistor R5 by using the circuitry enclosed by broken lines in FIG. 12. In other words, in the above described current generating circuit, the MOS transistor to which a reference current is made to flow can be shifted from an N-channel type MOS transistor to a P-channel type MOS transistor or vice versa.

Figure 13:
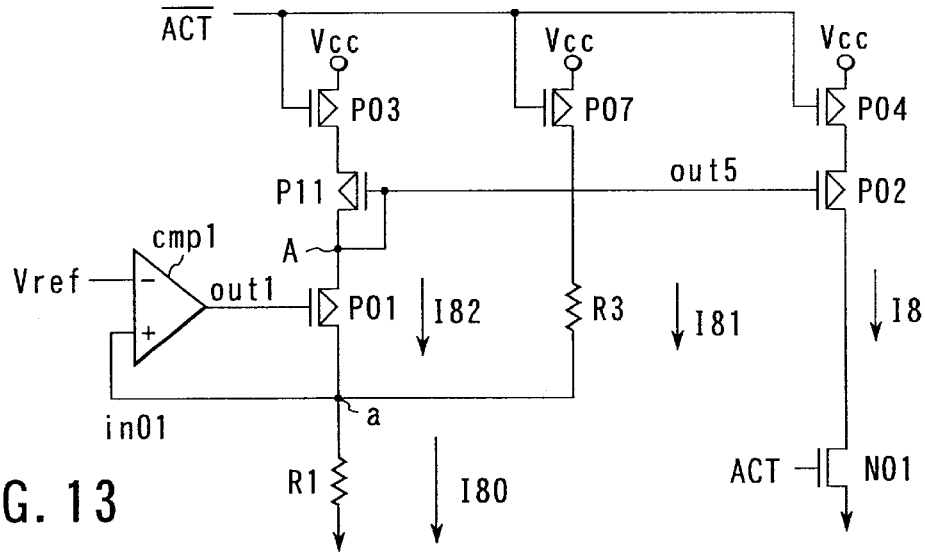
FIG. 13 is a schematic circuit diagram of still another embodiment of a current generating circuit according to the invention.

FIG. 13 is a circuit diagram of a current generating circuit according to the invention and obtained by modifying the current generating circuit of FIG. 6.

By comparing the current generating circuit with that of FIG. 6, it will be seen that the former differs from the latter in that a P-channel MOS transistor P11 having a gate connection (mutual connection of the gate and the drain) is added and the gate of the MOS transistor P02 is connected to the gate of the MOS transistor P11.

With this current generating circuit again, the current value of each of the current paths of the circuit is determined by the elements to which neither of the signals ACT, /ACT is applied (the MOS transistors P01, P02, P11 and the resistors R1, R3).

In the current generating circuit, the condition of Vref=in01 is maintained by the differential amplifiers in operation.

Now, the current I82 is expressed by the formula below:

$$I82=I80-I81$$
$$=Vref/R1-(Vcc-Vref)/R3.$$

Additionally, since the gates of the MOS transistors P02, P11 are at a same potential level, the current I8 is expressed by the formula below:

$$I8=k16\times I82$$
$$=k16\times\{Vref/R1-(Vcc-Vref)/R3\},$$

where k16 is the current ratio of the MOS transistors P02, P11 whose gates are at a same potential level [=I(P02)/I(P11)] and hence can be set to a level not dependent on the supply potential.

Note that the above current formula is equivalent with that of I1 of the circuit of FIG. 6.

Thus, with a current generating circuit shown in FIG. 13 and having a configuration as described above, it is now possible to generate an output current that is expressed by the formula above in terms of supply potential Vcc.

Meanwhile, in the current generating circuit of FIG. 13 it is desirable that the MOS transistors P02, P11 show the same characteristics as transistors in order to make the current-value I8 stable.

Now, the characteristics of the circuit of FIG. 13 will be compared with those of the circuit of FIG. 6 within a range where the supply potential Vcc is operable.

With the circuit of FIG. 6, the potential of the node A is substantially equal to the supply potential Vcc. On the other hand, with the circuit of FIG. 13, the gate potential out5 of the MOS transistors P02, P11 is equal to Vcc—Vthp11, where the difference between the gate potential out5 and the supply potential Vcc is selected as threshold value (−Vthp11 (Vthp11>0)) for the MOS transistor P11 when the current value is I82. Thus, the potential of the node A of the circuit of FIG. 13 is lower than that of the node A of the circuit of FIG. 6 by the threshold value Vthp11 of the MOS transistor P11.

Thus, the operable lower limit of the supply potential Vcc is lower in the circuit of FIG. 6 than in the circuit of FIG. 13.

Figure 14:
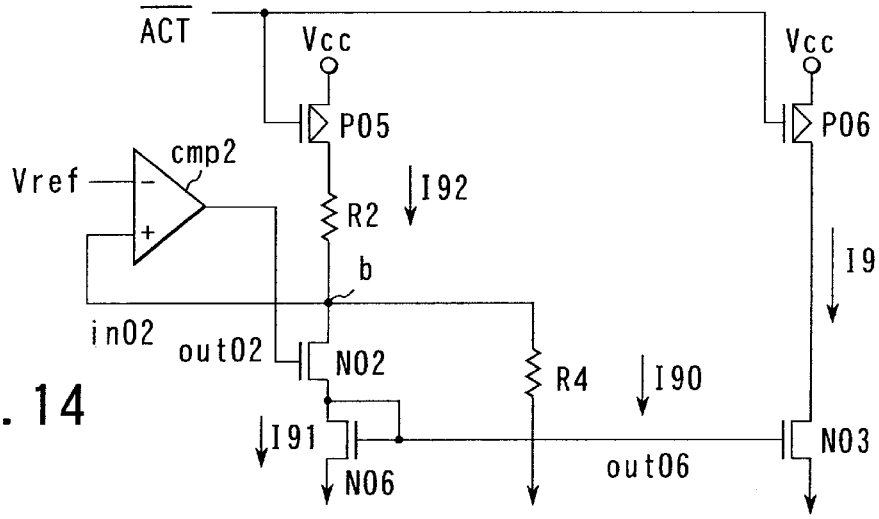
FIG. 14 is a schematic circuit diagram of still another embodiment of a current generating circuit according to the invention.

FIG. 14 is a circuit diagram of a current generating circuit according to the invention and obtained by modifying the current generating circuit of FIG. 7.

By comparing the current generating circuit with that of FIG. 7, it will be seen that the former differs from the latter in that an N-channel MOS transistor N06 having a gate connection (mutual connection of the gate and the drain) is added and the gate of the MOS transistor N03 is connected to the gate of the MOS transistor N06.

With this current generating circuit again, the current value of each of the current paths of the circuit is determined by the elements to which neither of the signals ACT, /ACT is applied (the MOS transistors N02, N03, N06 and the resistors R2, R4).

In the current generating circuit, the condition of Vref=in02 is maintained by the differential amplifiers in operation.

Now, the current I91 is expressed by the formula below:

$$I91=I92-I90$$
$$=(Vcc-Vref)/R2-Vref/R4.$$

Thus, the current I9 is expressed by the formula below:

$$I9-k17\times I91$$
$$=k17\times\{(Vcc-Vref)/R2-Vref/R4\},$$

where k17 is the current ratio of the MOS transistors N03, N06 whose gates are at a same potential level [=I(N03)/I(N06)] and hence can be set to a level not dependent on the supply potential.

Note that the above current formula is equivalent with that of I2 of the circuit of FIG. 7.

Thus, with a current generating circuit shown in FIG. 14 and having a configuration as described above, it is now possible to generate an output current that is expressed by the formula above in terms of supply potential Vcc.

Meanwhile, in the current generating circuit of FIG. 14 it is desirable that the MOS transistors N03, N06 show the same characteristics as transistors in order to make the current value I9 stable.

Now, the characteristics of the circuit of FIG. 14 will be compared with those of the circuit of FIG. 7 within a range where the supply potential Vcc is operable.

With the circuit of FIG. 7, the potential of the source of the MOS transistor N02 is the ground potential (0V). On the other hand, with the circuit of FIG. 14, the potential of the source of the MOS transistor N02 is higher than the ground potential (0V) by the threshold value Vthn06 of the MOS transistor N06, where the gate potential outO6 of the MOS transistor N06 is selected as threshold value Vthn06 (>0) for the MOS transistor N06 when the current value is I91.

Thus, the operable lower limit of the supply potential Vcc is lower in the circuit of FIG. 7 than in the circuit of FIG. 14.

Figure 15:
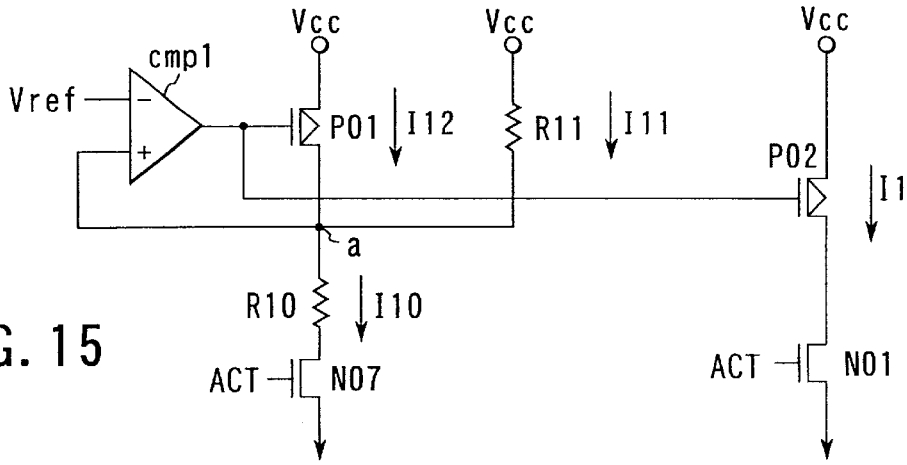
FIG. 15 is a schematic circuit diagram of still another embodiment of a current generating circuit according to the invention.

FIG. 15 is a circuit diagram of a current generating circuit according to the invention and obtained by modifying the current generating circuit of FIG. 6.

The circuit of FIG. 6 comprises four MOS transistors (P-channel transistors P03, P04, P07 and an N-channel MOS transistor N01) that are provided to reduce the current consumption when the circuit is not in operation (when signal ACT is at the ground potential and signal /ACT is at the supply potential Vcc) and to whose gates signal ACT or signal /ACT is applied. On the other hand, the circuit of FIG. 15 comprises two MOS transistors (N-channel MOS transistors N01, N07) to whose gates signal ACT is applied.

It will be appreciated that the means for reducing the current consumption for the purpose of the invention can be modified in many different ways as in the circuit of FIG. 15 where only N-channel MOS transistors are used.

Figure 16:
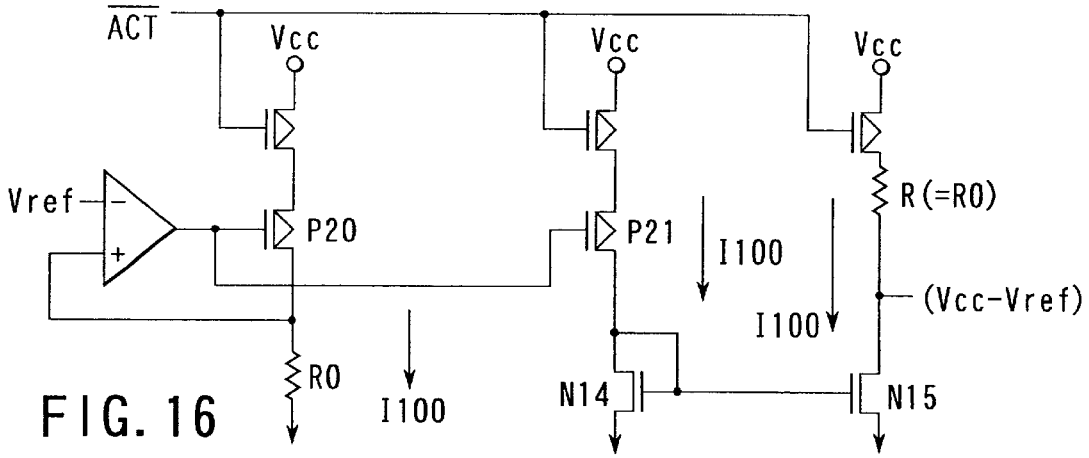
FIG. 16 is a circuit diagram of a circuit for generating Vcc−Vref.
Figure 17:
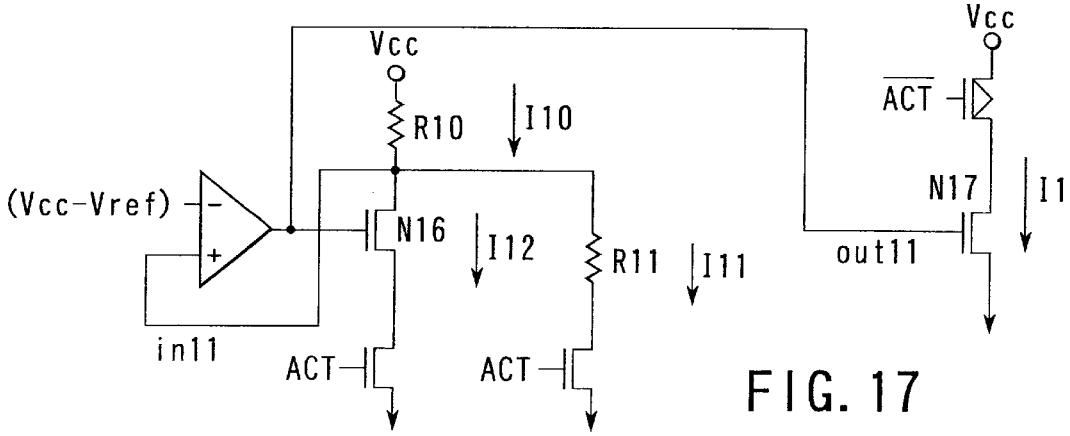
FIG. 17 is a schematic circuit diagram of still another embodiment of a current generating circuit according to the invention.
Figure 18:
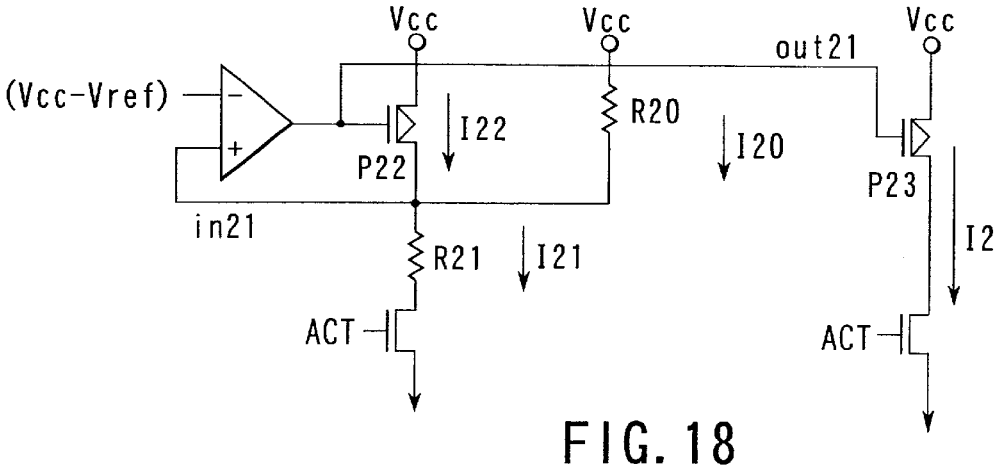
FIG. 18 is a schematic circuit diagram of still another embodiment of a current generating circuit according to the invention.

FIGS. 16 through 18 are circuit diagrams of other embodiments of a current generating circuit according to the invention and comprising a differential amplifier.

While Vref (a potential whose difference from the ground potential is not dependent on the supply potential) is used as reference potential for the differential amplifiers of the above embodiments (embodiments of FIGS. 4 through 15), Vcc−Vref (a potential whose difference from the supply potential is not dependent on the supply potential) may alternatively be used as reference potential for a differential amplifier as in the case of FIGS. 17 and 18 for the purpose of the invention.

FIG. 16 is a circuit diagram of a circuit adapted to generate Vcc−Vref.

In FIG. 16, P-channel MOS transistors P20, P21 have the gates commonly connected and are made to show a same current value for a same gate potential. Similarly, N-channel MOS transistors N14, N15 have the gates commonly connected and are made to show a same current value for a same gate potential.

Then, all the currents flowing to the MOS transistors P20, P21, N14, N15 show a same value. The current value I100 is expressed by the formula below.

$$I100=Vref/R0$$

If R=R0, the resistor R shows a potential difference of Vref at the opposite ends thereof and hence the potential of the ground potential side node of the resistor R is equal to Vcc−Vref.

FIG. 17 is a circuit diagram of an embodiment of a current generating circuit according to the invention and having a differential amplifier using Vcc−Vref as reference potential.

Since in11=Vcc−Vref in this circuit, the currents I10, I11, I12 are expressed respectively by the formulas below:

$$I10=Vref\ R10,$$

$$I11=(Vcc-Vref)/R11 \text{ and}$$

$$I12=I10-I11.$$

Therefore, the current I1 is expressed by the formula below:

$$I7=k3\times I12$$

$$=k3\times\{Vref/R10-(Vcc-Vref)/R11\},$$

where k3 is the current ratio of the MOS transistors N16, N17 whose gates are at a same potential level [=I(N17)/I(N16)] and hence can be set to a level not dependent on the supply potential.

The currents I10, I11, I12, I1 in FIG. 6 are the same as the currents I10, I11, I12, I1 in FIG. 17. Note that the above formulas are prepared by assuming k3=I(P02)/I(P01)=I(N17)/(N16).

FIG. 18 is a circuit diagram of another embodiment of a current generating circuit according to the invention and having a differential amplifier using Vcc−Vref as reference potential.

Since in21=Vcc−Vref in this circuit, the currents I20, I21, I22 are expressed respectively by the formulas below:

$$I20=Vref\ R20,$$

$$I21=(Vcc-Vref)/R21 \text{ and}$$

$$I22=I20-I21$$

$$=(Vcc-Vref)/R11-Vref/R10.$$

Therefore, the current I2 is expressed by the formula below:

$$I2=k4\times I22$$

$$=k4\times\{(Vcc-Vref)/R11-Vref/R10\},$$

where k4 is the current ratio of the MOS transistors P22, P23 whose gates are at a same potential level [=I(P23)/I(P22)] and hence can be set to a level not dependent on the supply potential.

The currents I20, I21, I22, I2 in FIG. 7 are the same as the currents I20, I21, I22, I2 in FIG. 18. Note that the above formulas are prepared by assuming k4=I(N03)/I(N02)=I(P23)/(P22).

While [Vcc−Vref] is used as reference potential for the differential amplifiers of the above embodiments of FIGS. 16 through FIG. 18, [Vcc−Vref] may be replaced by [Vcc−2×Vref] or some other reference potential without a problem for the purpose of the invention.

For example, [Vcc−2×Vref] can be generated by using the circuit for generating [Vcc−Vref] in FIG. 16 and making it to show a relationship of R=2×RO. Alternatively, [Vcc−2×Vref] can be generated by making the current drive capacities of the MOS transistors P20, P21 to show a relationship of P20:P21=1:2 or those of the MOS transistors N14, N15 to show a relationship of N14:N15=1:2.

Figure 19:
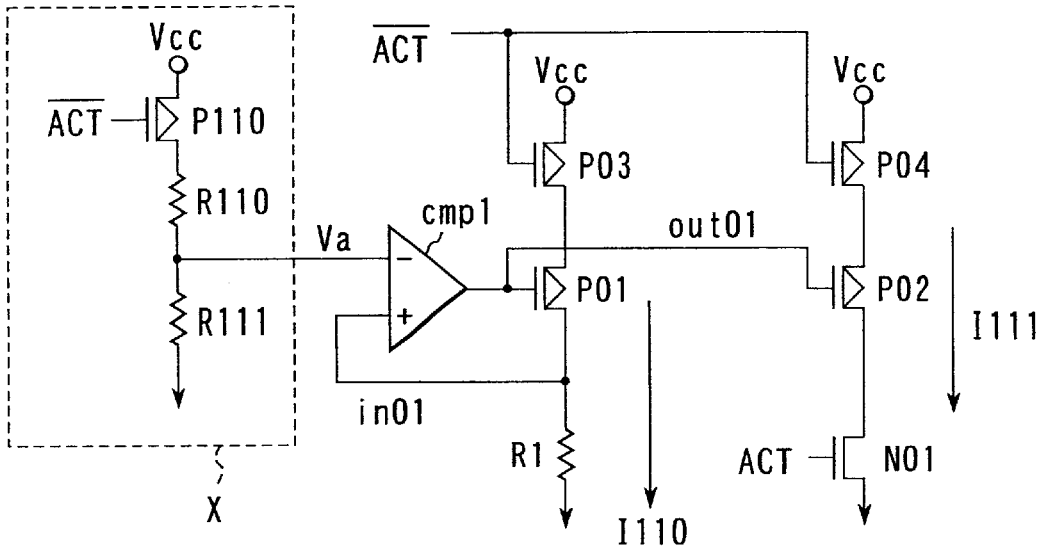
FIG. 19 is a schematic circuit diagram of still another embodiment of a current generating circuit according to the invention.

FIG. 19 is a circuit diagram of a current generating circuit according to the invention and comprising a differential amplifier.

The current generating circuit of FIG. 19 is realized by modifying that of FIG. 4. This circuit is characterized in that potential Va (=α×Vcc) that is proportional to the supply potential is used as reference potential for the differential amplifier cmp1 thereof.

In this embodiment, a resistance division method is used to generate the reference potential Va. More specifically, the potential of the contact point of resistors R110, R111 connected in series between the supply terminal and the grounding terminal of the circuit and enclosed by broken lines X in FIG. 19 is selected for the reference potential Va. Note that the MOS transistor P110 that is enclosed by broken lines X and to which signal /ACT is applied is used to reduce the consumed current while the circuit is not in operation.

Since the relationship of in01=Va=α×Vcc holds true in this circuit, the currents I110, I111 are expressed by the formulas below:

$$I110=Va/R1=\alpha\times Vcc/R1 \text{ and}$$

$$I111=k18\times I110=k18\times\alpha\times Vcc/R1,$$

where k18 is the current ratio of the MOS transistors P01, P02 whose gates are at a same potential level [=I(P02)/I(P01)] and hence can be set to a level not dependent on the supply potential.

Figure 20:
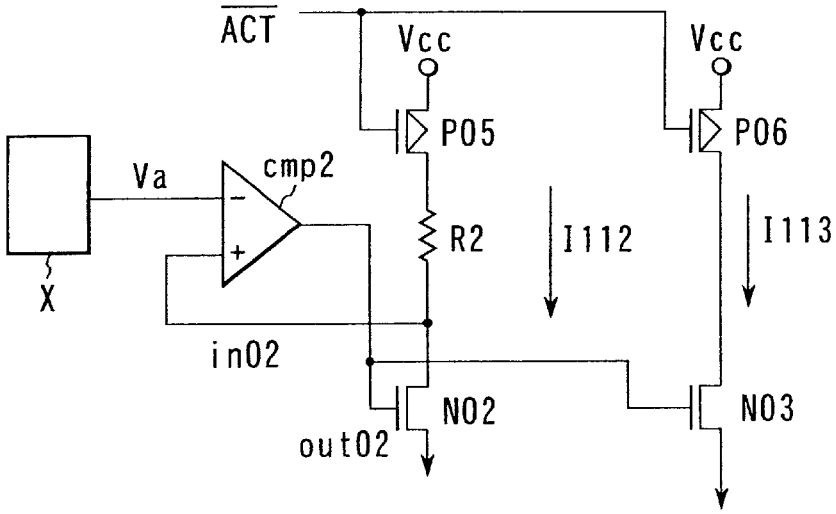
FIG. 20 is a schematic circuit diagram of still another embodiment of a current generating circuit according to the invention.

FIG. 20 is a circuit diagram of another current generating circuit according to the invention and comprising a differential amplifier.

The current generating circuit of FIG. 20 is realized by modifying that of FIG. 5. This circuit is characterized in that potential Va (=α×Vcc) that is proportional to the supply potential is used as reference potential for the differential amplifier cmp1 thereof.

In this embodiment, a resistance division method is used to generate the reference potential Va as in the case of the embodiment of FIG. 19.

Since the relationship of in111=Va=α×Vcc holds true in this circuit, the currents I112, I113 are expressed by the formulas below:

$$I112=(Vcc-Va)/R2=(1-\alpha)\times Vcc/R21 \text{ and}$$

$$I113=k19\times I112=k19\times(1-\alpha)\times Vcc/R2,$$

where k19 is the current ratio of the MOS transistors N02, N03 whose gates are at a same potential level [=I(N03)/I(N02)] and hence can be set to a level not dependent on the supply potential.

Figure 21:
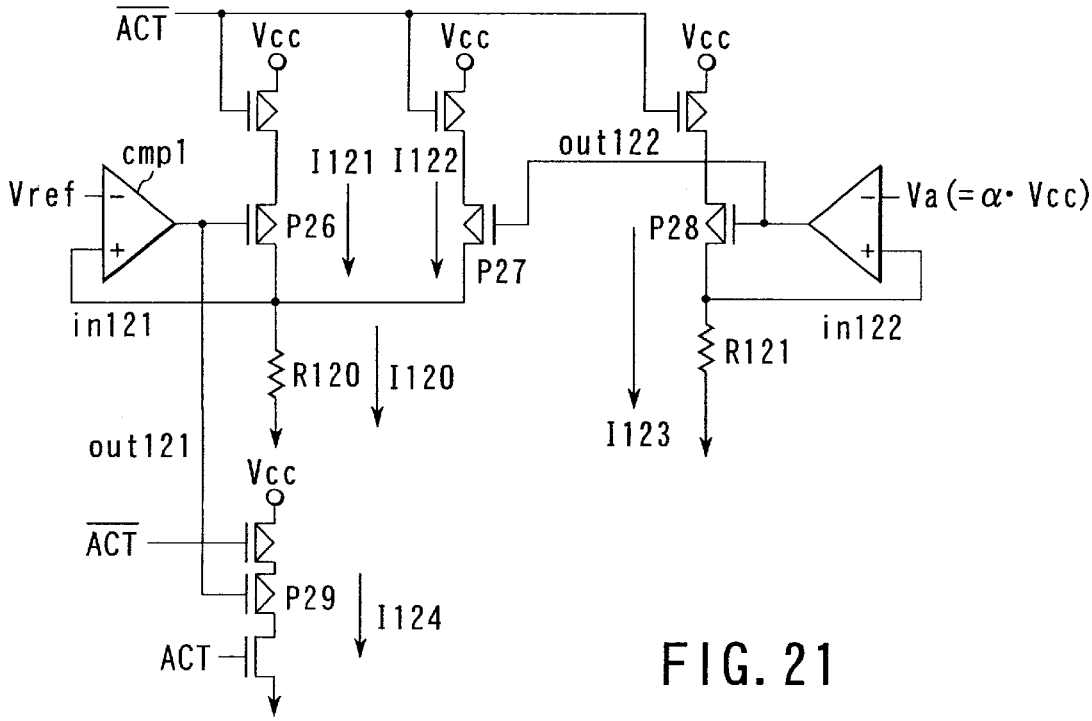
FIG. 21 is a schematic circuit diagram of still another embodiment of a current generating circuit according to the invention.

FIG. 21 is a schematic circuit diagram of another current generating circuit according to the invention and having two differential amplifiers.

This current generating circuit is realized by combining a current generating circuit as shown in FIG. 4 and a current generating circuit as shown in FIG. 19.

Since the relationships of in121=Vref, in121=Va=$\alpha\times$Vcc holds true in this circuit, the currents I120, I121, I122 are expressed by the formulas below:

$$I120=Vref/R120,$$

$$I123=Va/R121=\alpha\times Vcc/R121 \text{ and}$$

$$I122=k20\times I123=k20\times\alpha\times Vcc/R121,$$

where k20 is the current ratio of the MOS transistors P27, P28 whose gates are at a same potential level [=I(P27)/I(P28)] and hence can be set to a level not dependent on the supply potential.

Additionally, the current I121 is expressed by the formula below.

$$I121=I120-I122$$

$$=Vref/R120-k20\times\alpha\times Vcc/R121$$

Therefore, the current I124 is expressed by the formula below:

$$I124=k21\times I121$$

$$=k21\times\{Vref/R120-K20\times\alpha\times Vcc/R121\},$$

where k21 is the current ratio of the MOS transistors P26, P29 whose gates are at a same potential level [=I(P29)/I(P26)] and hence can be set to a level not dependent on the supply potential.

Thus, with a current generating circuit shown in FIG. 21 and having a configuration as described above, it is now possible to generate output currents that are expressed by the formulas above in terms of supply potential Vcc.

Figure 22:
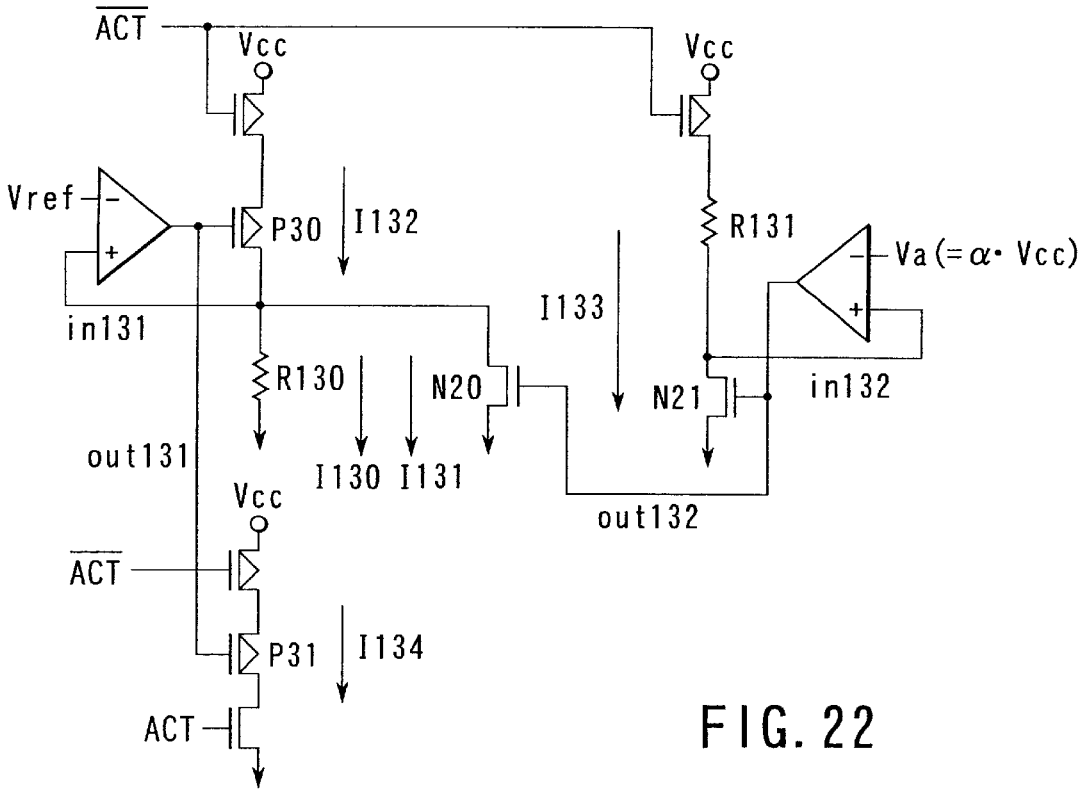
FIG. 22 is a schematic circuit diagram of still another embodiment of a current generating circuit according to the invention.

FIG. 22 is a schematic circuit diagram of still another current generating circuit according to the invention and having two differential amplifiers.

This current generating circuit is realized by combining a current generating circuit as shown in FIG. 5 and a current generating circuit as shown in FIG. 20.

Since the relationships of in131=Vref, in132=Va=$\alpha\times$Vcc holds true in this circuit, the currents I130, I133, I131 are expressed by the formulas below:

$$I130=Vref/R130,$$

$$I133=(Vcc-Va)/R131)$$

$$=(1-\alpha)\times Vcc/R131 \text{ and}$$

$$I131=k22\times I133$$

$$=k22\times(1-\alpha)\times Vcc/R131,$$

where k22 is the current ratio of the MOS transistors N20, N21 whose gates are at a same potential level [=I(N20)/I(N21)] and hence can be set to a level not dependent on the supply potential.

Additionally, the current I132 is expressed by the formula below.

$$I132=I130+I131$$

$$=Vref/R130+k22\times(1-\alpha)\times Vcc/R131$$

Therefore, the current I134 is expressed by the formula below:

$$I134=k23\times I132$$

$$=k23\times\{Vref/R130+K22\times(1-\alpha)\times Vcc/R131\},$$

where k22 is the current ratio of the MOS transistors P30, P31 whose gates are at a same potential level [=I(P31)/I(P30)] and hence can be set to a level not dependent on the supply potential.

Thus, with a current generating circuit shown in FIG. 22 and having a configuration as described above, it is now possible to generate output currents that are expressed by the formulas above in terms of supply potential Vcc.

Thus, by means of any of the circuits shown in FIGS. 4 through 22, it is possible to generate an electric current that shows a variable dependency on the supply potential Vcc.

Of the above circuits, those except the circuits of FIGS. 10 through 12 have an advantage that the current value is not dependent on the threshold value of the related MOS transistor because it is determined as a function of the related resistor.

It is possible to configure various circuits with different characteristics by using the electric current generated by any of the above described current generating circuits.

Now, some circuits that utilize the electric current generated by any of the above described current generating circuits will be discussed below.

Figure 23:
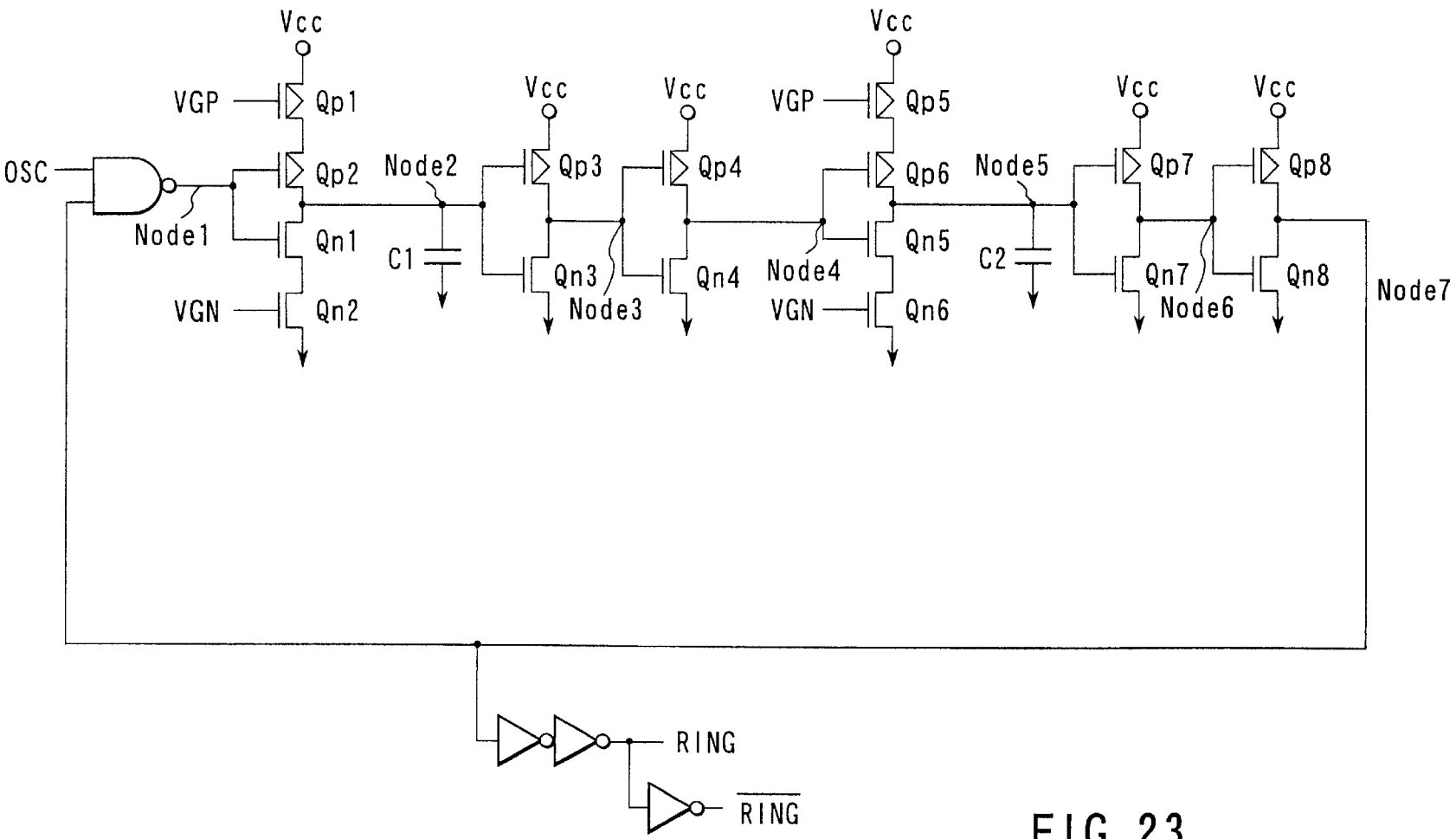
FIG. 23 is a schematic circuit diagram of an oscillator adapted to use an output signal of a current generating circuit according to the invention.

FIG. 23 is a circuit diagram of an oscillator utilizing a current generating circuit according to the invention.

The oscillation signals RING, /RING of this circuit are generated when signal OSC is at the level of the supply potential Vcc and shows a waveform as illustrated in FIG. 24.

Signals VGP, VGN are generated by other respective circuits.

In this circuit, the charging/discharging time of the capacitor C1 by the inverter constituted by MOS transistors Qp1, Qp2, Qn1, Qn2 and the charging/discharging time of the capacitor C2 by the inverter constituted by MOS transistors Qp5, Qp6, Qn5, Qn6 significantly affect the oscillation period of the circuit. In other words, the inverters and the NAND gates other than these two inverters operate relatively at high speed and hence do not significantly affect the oscillation period of the circuit.

With this circuit, a sufficiently large value can be selected for the resistance of the MOS transistors Qp1, Qp5 relative to that of the MOS transistors Qp2, Qp6 by controlling the level of signal VGP. In other words, the charging time of the capacitors C1, C2 can be controlled by controlling the signal level of signal VGP.

Similarly, the discharging time of the capacitors C1, C2 can be controlled by controlling the signal level of signal VGN.

Thus, because the charging/discharging time of the capacitors C1, C2 can be controlled by controlling the signal level of signals VGP, VGN, consequently the oscillation period of the circuit can be controlled by controlling the signal level of signals VGP, VGN.

Now, let us assume that the threshold value of the inverter constituted by MOS transistors Qp3, Qn3 and the inverter constituted by MOS transistors Qp7, Qn7 is Vcc/2.

If C1=C2=C0, the time required from a potential change of the node Node1 from 0V to Vcc to a subsequent potential change of the node Node3 from 0V to Vcc is expressed by the formula below.

$$C0\times(Vcc-Vcc/2)/I(VGP)$$

$$=C0\times(Vcc/2)/I(VGP) \quad (11\text{-}1)$$

Likewise, the time required from a potential change of the node Node1 from Vcc to 0V to a subsequent potential change of the node Node3 from Vcc to 0V is expressed by the formula below.

$$=C0\times(Vcc/2)/I(VGN) \quad (11\text{-}2)$$

Then, the oscillation period Tosc is expressed by the formula below.

$$Tosc=C0\times(Vcc/2)\times\{1/I(VGP)+1/I(VGN)\} \quad (11\text{-}3)$$

In the above formulas, I(VGP) denotes the electric current flowing to the P-channel MOS transistors Qp1, Qp5 to whose gates signal VGP is applied, whereas I(VGN) denotes the electric current flowing to the N-channel MOS transistors Qn2, Qn6 to which gates signal VGN is applied.

FIG. 25 is a circuit diagram of a circuit adapted to generate signals VGP, VGN.

This circuit is prepared on the basis of the circuit of FIG. 19 and hence the components corresponding to those of FIG. 19 are denoted respectively by the same reference symbols.

It should be noted that the load capacity of the output node of the differential amplifier cmp1 has to be reduced in order to curtail the response time of the differential amplifier cmp1.

Therefore, in this circuit, the output node of the differential amplifier cmp1 is not directly used as VGP node. In other words, signal VGN is generated by the component circuit enclosed by broken lines in FIG. 25 and then signal VGP is generated on the basis of the signal VGN.

It will be appreciated that the circuit component enclosed by broken lines in FIG. 25 is realized by combining two identical circuit components, each having a configuration as the one enclosed by broken lines in FIG. 12, and hence operates on the same principle as that of the circuit component in FIG. 12.

Thus, the current I110 is expressed by the formula below:

$$I110=Va/R1=\alpha\times Vcc/R1$$

and hence it will be seen that the current I110 is proportional to the supply potential Vcc.

On the other hand, the currents I140, I141 are expressed by the formulas below:

$$I140=k24\times\alpha\times Vcc/R1$$

where k24 is the current ratio of the MOS transistors P01, P02 whose gates are at a same potential level [=I(P02)/I(P01)] and hence can be set to a level not dependent on the supply potential, and $$I141=k25\times k24\times\alpha\times Vcc/R1$$

where k25 is the current ratio of the MOS transistors N22, N23 whose gates are at a same potential level [=I(N23)/I(N22)] and hence can be set to a level not dependent on the supply potential.

Therefore, since both electric currents I140, I141 are proportional to the supply potential Vcc and hence both electric current I(VGP), I(VGN) are proportional to the supply potential Vcc.

Then, as seen from the above formula (11-3), the oscillation period of the circuit of FIG. 23 shows a constant value and does not depend on the supply potential Vcc.

Thus, an oscillation signal having a constant period that is not dependent on the supply potential Vcc can be generated by combining the circuits of FIGS. 23 and 25.

The circuit obtained by combining the circuits of FIGS. 23 and 25 can be very effective when it is used as a timer in a memory chip. More specifically, if such a timer is used to control the operation time of a data reading operation and the timing of each operation of a memory, the memory can be driven to operate in a stable manner without being affected by the supply potential Vcc.

Additionally, since the operation time and the timing of each operation of each component circuit of the chip are no longer dependent on the supply potential Vcc, the chip can be made to operate over a wide range of supply potential (regardless of fluctuations of the supply potential).

FIG. 26 is a circuit diagram of another circuit adapted to generate signals VGP, VGN.

This circuit is prepared on the basis of the circuit of FIG. 4 and hence the components corresponding to those of FIG. 4 are denoted respectively by the same reference symbols.

Thus, the current I01 of this circuit is expressed by the formula below.

$$I01=Vref/R1$$

Then, it will be seen that the currents I150, I151 are not dependent on the supply potential Vcc as the current I01.

Therefore, when output signals VGP, VGN of the circuit of FIG. 26 are used for the VGP and the VGN of the oscillator of FIG. 23, the currents I(VGP), I(VGN) are not dependent on the supply potential Vcc.

As seen from the equation (11-3) above, the oscillation period of the circuit of FIG. 23 is proportional to the supply potential Vcc. Oscillation signals RING, /RING showing such characteristics can effectively be used as drive signals for a booster of a semiconductor memory.

Figure 27:
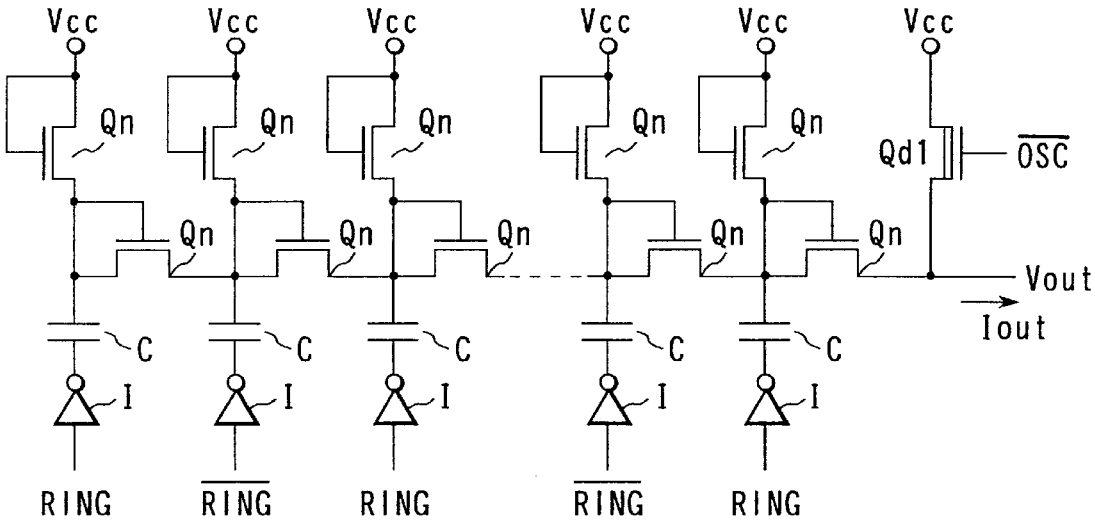
FIG. 27 is a schematic circuit diagram of a booster adapted to use an output signal of the oscillator of FIG. 23.

FIG. 27 is a schematic circuit diagram of a booster that can be realized by using a current generating circuit according to the invention.

Signal /OSC is held to the ground potential (0V) when the booster is in operation but it is held to the supply potential Vcc when the booster is not in operation. In FIG. 27, reference symbols Qd1 and Qn respective denote a depression type N-channel MOS transistor and an enhancement type N-channel MOS transistor.

This booster generates a potential higher than the supply potential Vcc on the basis of the supply potential Vcc and the drive signals RING, /RING and produces the potential as output potential Vout.

The output current of the booster is generally proportional to Vcc−Vthn (where Vthn represents the threshold value of the MOS transistor Qn) and inversely proportional to the oscillation period Tosc of the oscillation signals RING, /RING. Therefore, if the number of units (the total number of the capacitors and the inverters) of the booster is n, the output current Iout and the consumed current Icc are expressed by formulas below:

$$Iout=k26\times(Vcc-Vthn)/Tosc \quad (15\text{-}1)$$

and $$Icc=k27\times(n+1)\times(Vcc-Vthn)/Tosc \quad (15\text{-}2),$$

where k26 and k27 are constants and not dependent on the supply potential.

To make the chip operate in a stable fashion practically without relying on the supply potential Vcc, it is desirable that both the output current Iout and the consumed current Icc are scarcely dependent on the supply potential Vcc. In other words, it will be seen from the above formulas (15-1) and (15-2) that the oscillation period Tosc is proportional or nearly proportional to Vcc−Vthn.

In a system (a) realized by combining the circuit of FIG. 23 and that of FIG. 25, the oscillation period Tosc will be constant and not dependent on the supply potential Vcc. On the other hand, in a conventional circuit (b), the oscillation period Tosc is reduced as the supply potential Vcc rises (if VGP is held to 0V and VGN is held to Vcc).

To the contrary, in a system realized by combining the circuit of FIG. 23 and that of FIG. 26, the oscillation period Tosc is proportional to the supply potential Vcc and hence the system can produce RING, /RING that are proportional to the supply potential Vcc. Then, the oscillation period of the system is characterized by its proportionality or quasi-proportionality relative to Vcc−Vthn if compared with either of the above systems (a) and (b).

Thus, by using a system prepared by combining the circuit of FIG. 23 and that of FIG. 26, it is possible to make the chip operate in a stable manner without relying on the supply potential Vcc.

On the other hand, in the system realized by combining the circuit of FIG. 23 and that of FIG. 25, it will be seen from the above formulas (15-1) and (15-2) that the dependency of the output current Iout and the consumed current Icc on the supply potential Vcc can be reduced significantly if compared with the system (b) above whose oscillation period Tosc is reduced as the supply potential Vcc rises (if VGP=0V, VGN=Vcc).

Figure 28:
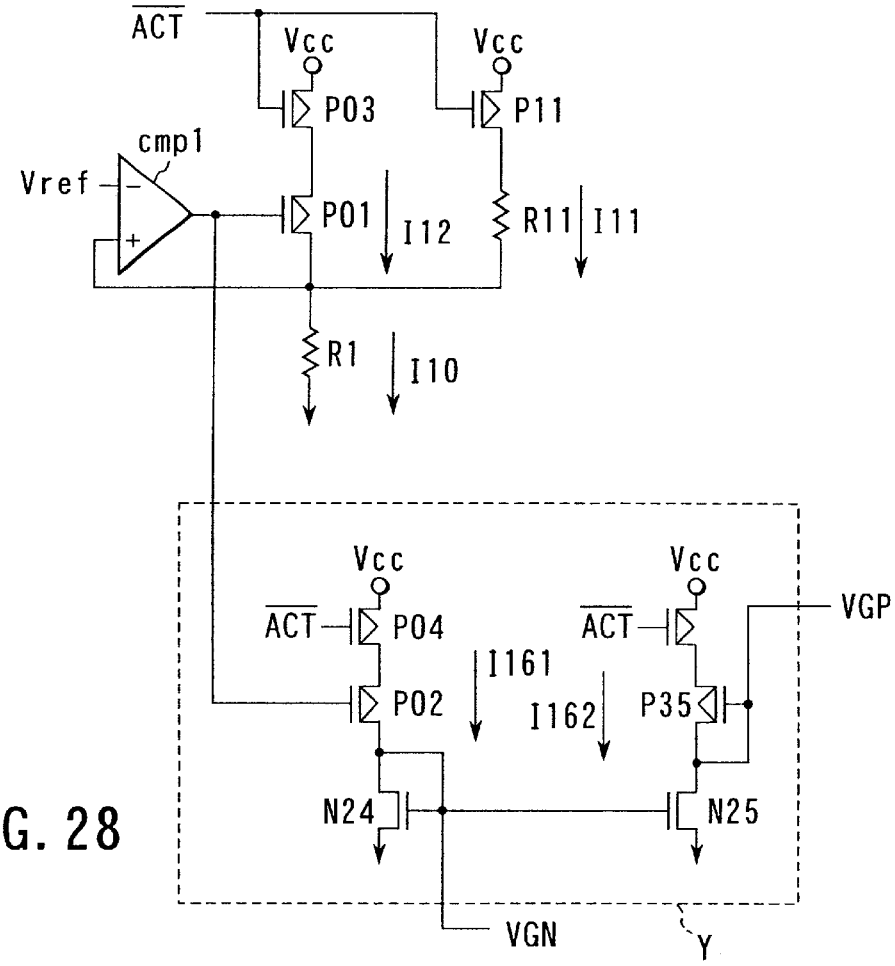
FIG. 28 is a schematic circuit diagram of still another circuit for generating a signal to be applied to the oscillator of FIG. 23.

FIG. 28 is a circuit diagram of still another circuit adapted to generate signals VGP, VGN.

This circuit is realized by modifying that of FIG. 26 and hence the elements and the regions of the circuits corresponding to their counterparts of FIG. 26 are denoted respectively by the same reference symbols.

This circuit differs from that of FIG. 26 in that it additionally comprises a P-channel MOS transistor P11 and a resistor R11. In other words, this circuit is identical with that of FIG. 6 except the region enclosed by broken lines.

Thus, the current I12 is expressed by the formula below.

$$I12=I10-I11$$
$$=Vref/R1-(Vcc-Vref)/R11$$
$$=Vref\times\{(1/R1)+(1/R11)\}-Vcc/R11$$

Additionally, both currents I(VGP) and I(VGN) are reduced as the supply potential Vcc rises as in the case of the current I12.

In a system obtained by combining the oscillator of FIG. 23 and the circuit of FIG. 28, the oscillation period Tosc of the circuit of FIG. 23 is proportional to $1/[Vref\times\{1/R1+1/R11\}-Vcc/R11]$. In other words, this system is characterized in that the oscillation period Tosc is prolonged as the supply potential Vcc rises.

Then, it is possible to make the oscillation period Tosc of the circuit of FIG. 23 proportional or nearly proportional to Vcc−Vthn by regulating the values of the resistors R1, R11 and the reference potential Vref.

Thus, by using a system obtained by combining the circuit of FIG. 23 and that of FIG. 28, the output current Iout and the consumed current Icc can be made less dependent on the supply potential Vcc than those of the system realized by combining the circuit of FIG. 23 and that of FIG. 26 (where Tosc is proportional to Vcc) so that a chip using such a system can operate in a stable fashion.

Figure 29:
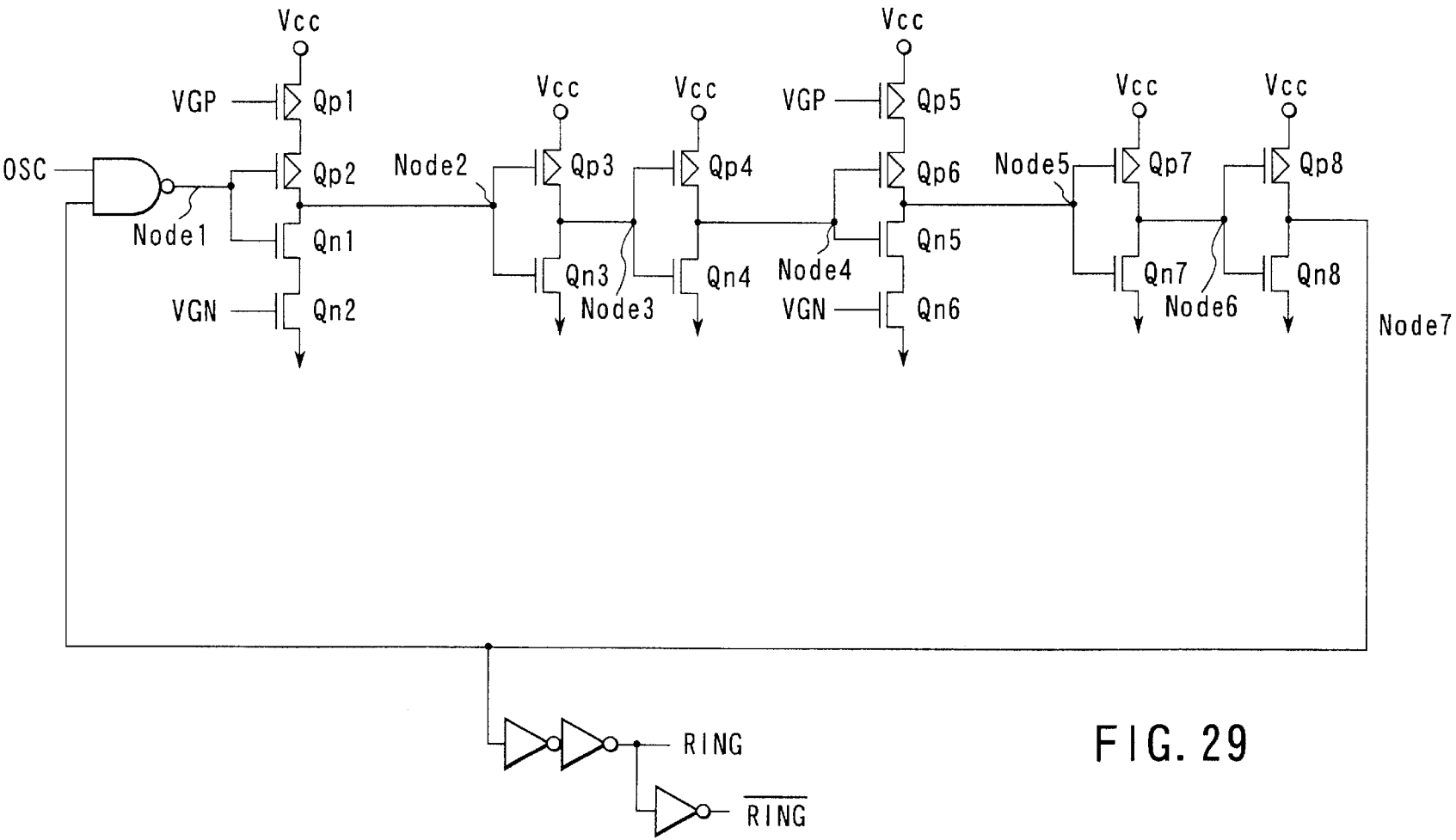
FIG. 29 is a schematic circuit diagram of another oscillator adapted to use an output signal of a current generating circuit according to the invention.

While systems obtained by combining the oscillator of FIG. 23 and the circuits of FIGS. 25, 26 and 28 for generating control signals VGP, VGN are described above, the circuit of FIG. 23 may be replaced by that of FIG. 29 for the purpose of the invention.

A system realized by combining the oscillator of FIG. 29 and the circuit of FIG. 25, 26 or 28 for generating control signals VGP, VGN will operates in a manner the same as any of the above described systems.

The oscillator of FIG. 29 is characterized in that the capacitors C1, C2 of the oscillator of FIG. 23 are omitted.

With such a circuit configuration, the circuit of FIG. 29 can be made to operate like that of FIG. 23 by controlling the electric currents I(VGP), I(VGN).

In either of the circuits of FIGS. 23 and 29, the threshold value of the inverter constituted by the MOS transistors Qp3, Qn3 and the inverter constituted by MOS transistors Qp7, Qn7 remarkably affects the oscillation period Tosc. Therefore, possible fluctuations of the threshold value of the inverters due to the variances in the characteristics of the transistors that can be produced during the manufacturing process can be minimized by increasing the gate length of the MOS transistors Qp3, Qn3, Qp7, Qn7 relative to the other MOS transistors.

Additionally, it is desirable that the variances in the characteristics of the MOS transistors where the electric current I(VGP) or I(VGN) flow are minimized in order to make the currents I(VGP) or I(VGN) flow in a stable fashion in the circuits of FIGS. 23 and 29 regardless of the variances in the characteristics of the transistors that can be produced during the manufacturing process. This can be effectively achieved by making the gate length of the MOS transistors Qp1, Qn2, Qp5, Qn6 longer than that of the other MOS transistors.

Additionally, the variances in the characteristics of the transistors can be minimized by making the parameters including the channel length of the MOS transistors P33, P35 of the circuits of FIGS. 25, 26 and 28 and the MOS transistors Qp1, Qp5 of the circuits of FIGS. 23 and 29 agree with each other.

Similarly, the variances in the characteristics of the transistors can be minimized by making the parameters including the channel length of the MOS transistors N22, N24 of the circuits of FIGS. 25, 26 and 28 and the MOS transistors Qn2, Qn6 of the circuits of FIGS. 23 and 29 agree with each other.

Figure 30:
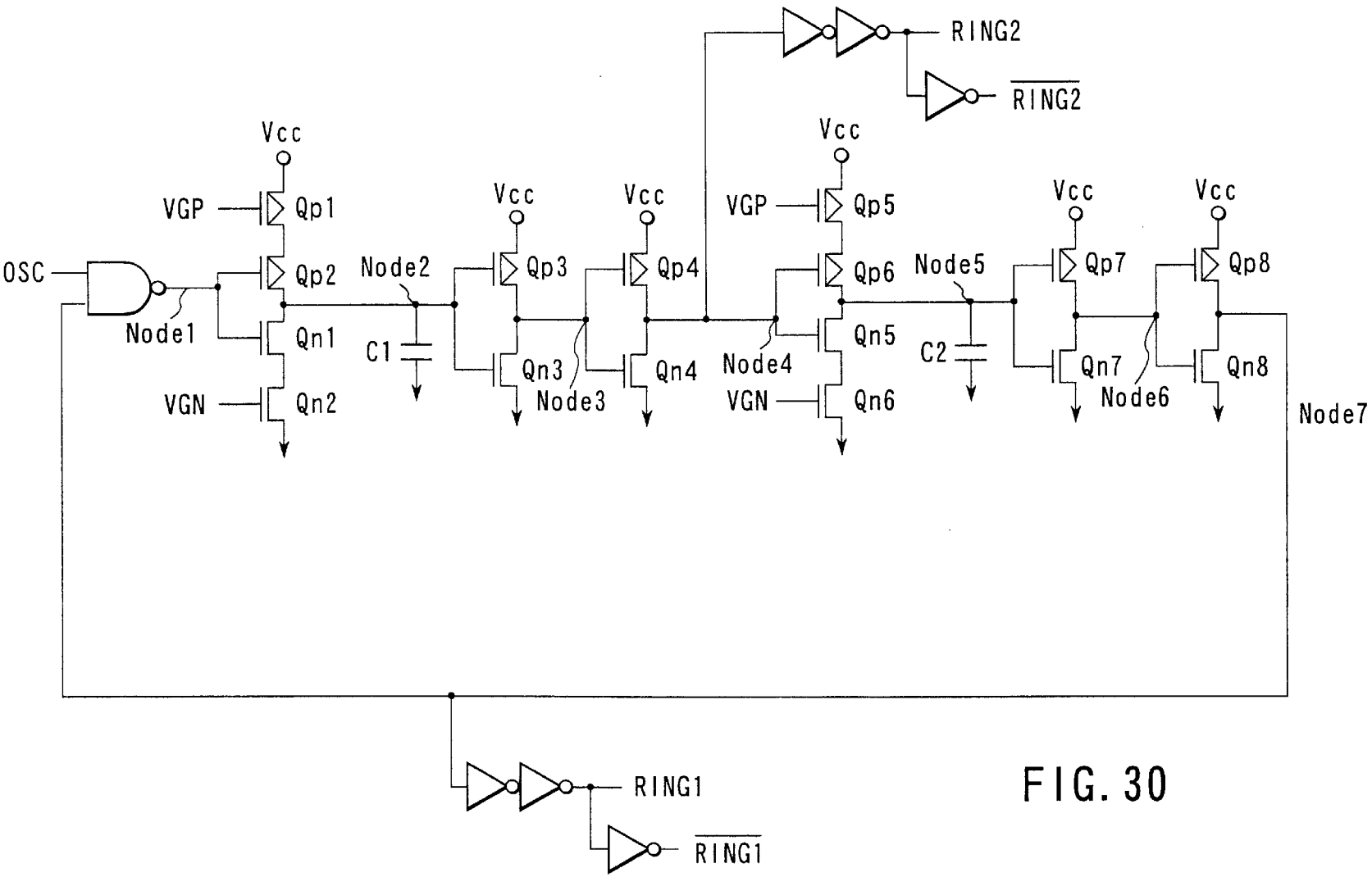
FIG. 30 is a schematic circuit diagram of still another oscillator adapted to use an output signal of a current generating circuit according to the invention.
Figure 31:
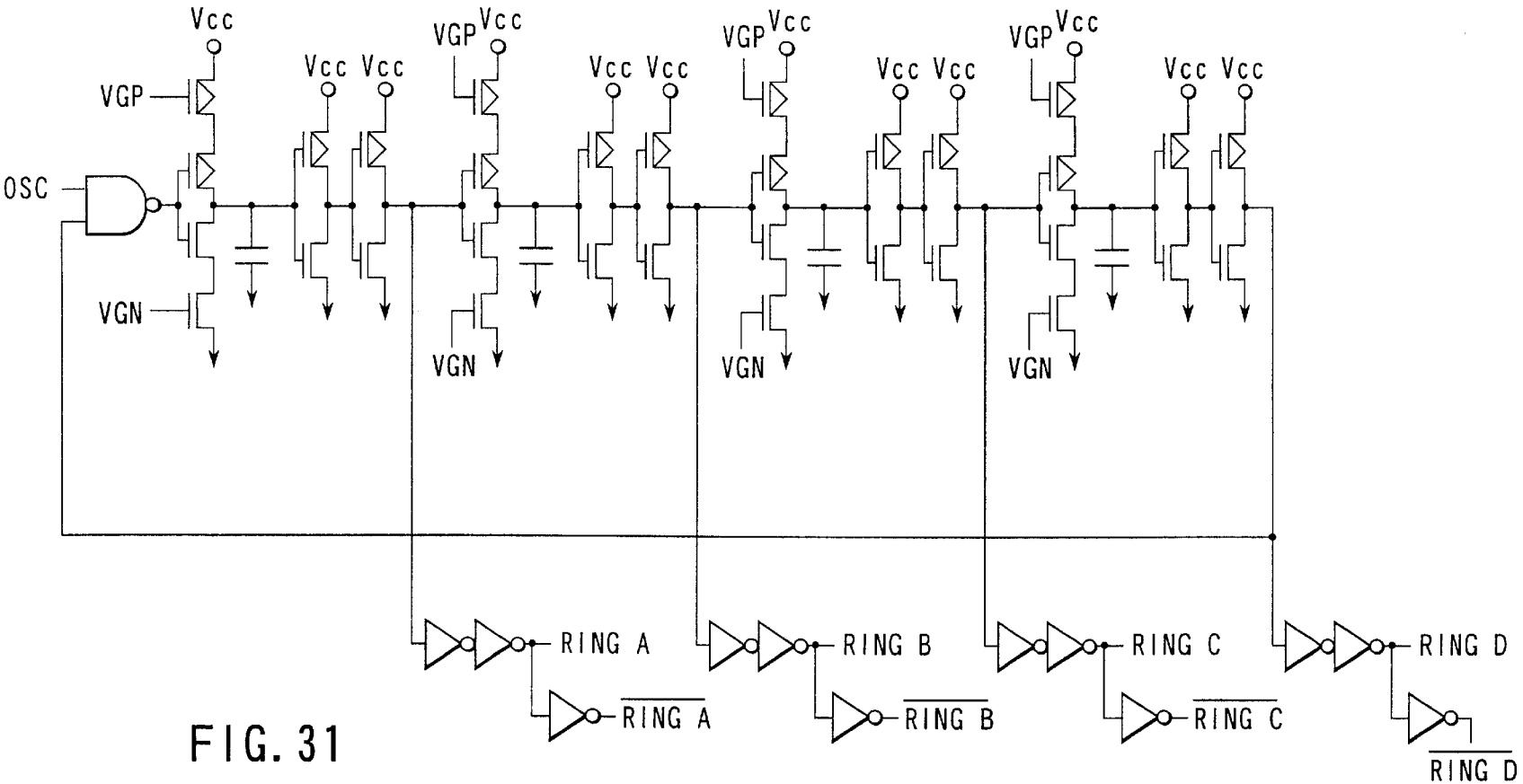
FIG. 31 is a schematic circuit diagram of still another oscillator adapted to use an output signal of a current generating circuit according to the invention.

Any of the circuits of FIGS. 25, 26, 28 may also be combined not only with the oscillator of FIG. 23 or FIG. 29 but also with the oscillator of FIG. 30 or FIG. 31 for the purpose of the invention by utilizing any of the above described means.

The output signals RING1, /RING2, RING2, /RING2 of the oscillator of FIG. 30 show a waveform as illustrated in FIG. 32, whereas the output signals RINGA, /RINGA, RINGB, /RINGB, RINGC, /RINGC, RINGD, /RINGD of the oscillator of FIG. 31 show a waveform as illustrated in FIG. 33.

Output signals showing such stable waveforms will then fed to timers and boosters of a memory chip.

The advantages of applying any of the circuits of FIGS. 25, 26 and 28 to any of the circuits of FIGS. 23, 29, 30 and 31 have been described above. However, the characteristic features and the advantages of the present invention are not limited thereto and the above embodiments can be modified in many different ways. Differently stated, an electric current showing dependency on the supply potential Vcc in many different ways can be generated by using the circuit of FIG.

4 or 22 and the circuits of FIGS. 23, 29, 30 and 31 can be made to show various characteristic features by applying such an electric current to those circuits.

Some of the above described embodiments are adapted to generate an electric current by using the sum or the difference of two electric currents as a reference. However, according to the present invention, it is also effectively possible to generate an electric current by using the sum of the difference of more than two electric current as a reference.

FIG. 34 is a circuit diagram of a current generating circuit adapted to generate an electric current by using the sum of the difference of n electric currents.

In this embodiment, of the electric paths including resistors, the i electric paths are used to provide charging currents Inl through Ini for node inN and j electric paths are used to provide discharging currents In(k+1) through In(k+j) for node inN, whereas (k−i) electric paths are used to provide charging currents In(i+1) through Ink for node inN and (n−k−j) electric paths are used to provide discharging currents In(k+j+1) through Inn for node inN.

Thus, the electric current In0 is expressed by the formula below:

$$In0=In(k+1)+\ldots+In(k+j)+In(k+j+1)+In(k+j+2)+\ldots+Inn-In1-\ldots Ini-In(i+1)-In(i+2)-\ldots-Ink.$$

Thus, the electric current In is expressed by the formula below:

$$In=I(Pn)/I(Pn0)\times In0,$$

where I(Pn)/I(Pn0) corresponds to the current ratio of the MOS transistors Pn, Pn0 whose gates are at a same potential level.

Figure 35:
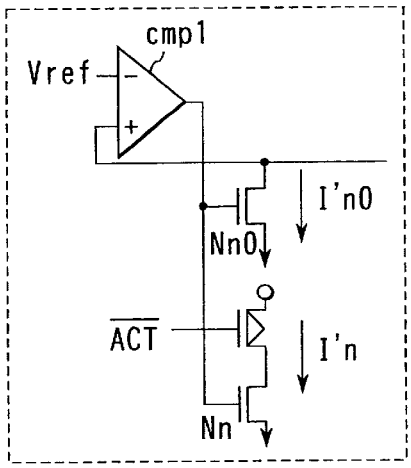
FIG. 35 is a schematic circuit diagram of a circuit obtained by modifying the portion of the circuit of FIG. 34 enclosed by broken lines in FIG. 34.

Note that the component circuit of the circuit of FIG. 34 enclosed by broken lines can be replaced by the circuit of FIG. 35.

If such is the case, the electric current I'n0 is expressed by the formula below:

$$I'n0=In1+\ldots+Ini+In(i+1)+In(i+2)+\ldots+Ink-In(k+1)-\ldots In(k+j)-In(k+j+1)-In(k+j+2)-\ldots-Inn.$$

Thus, the electric current I'n is expressed by the formula below:

$$I'n=I(Nn)/I(Nn0)\times I'n0,$$

where I(Nn)/I(Nn0) corresponds to the current ratio of the MOS transistors Nn, Nn0 whose gates are at a same potential level.

In either of the embodiments of FIGS. 34 and 35, the MOS transistor has the gate to receive the output signal of the differential amplifier and the drain connected directly to the positive side input terminal of the differential amplifier. However, the present invention is by no means limited to such an arrangement.

Figure 36:
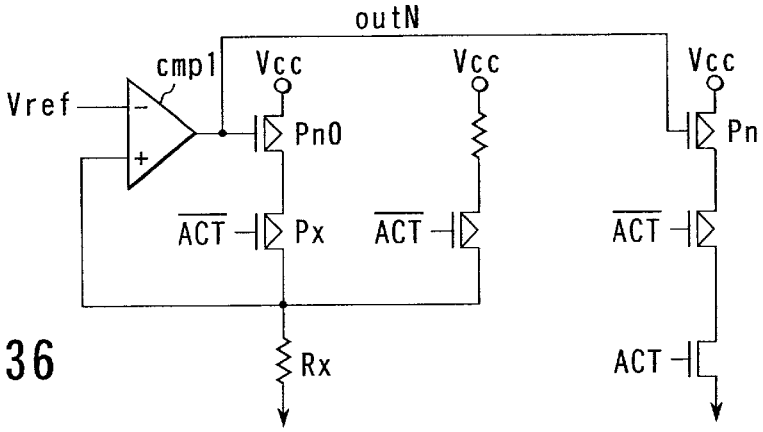
FIG. 36 is a schematic circuit diagram of still another embodiment of current generating circuit according to the invention.
Figure 37:
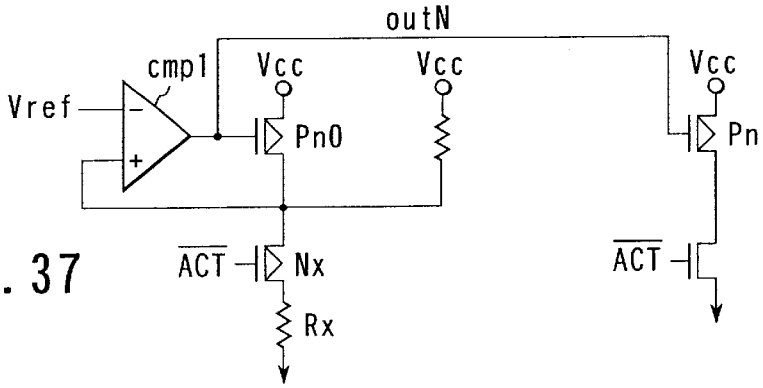
FIG. 37 is a schematic circuit diagram of still another embodiment of a current generating circuit according to the invention.

For example, as shown in FIG. 36, a P-channel MOS transistor Px may be connected to the positive side input terminal of the MOS transistor Pn0 and that of the differential amplifier cmp1 to reduce the consumed current when the circuit is not in operation. Alternatively, as shown in FIG. 37, an N-channel MOS transistor Nx and a resistor Rx may be connected in series between the MOS transistor Pn0 and the contact point to reduced the consumed current when the circuit is not in operation.

The specific circuit configuration of a differential amplifier to be used for the purpose of the invention is not limited to that of FIG. 2 or 3. Any other appropriate circuit configuration may be used for a differential amplifier to be used for the purpose of the invention.

While so many circuits are configured by using MOS transistors and resistors in the above embodiments, any of the resistors may be replaced by another element such as an MOS transistor, a diode or a bipolar transistor for the purpose of the invention.

Additionally, the element to be used for receiving the output signal of a differential amplifier is not limited to an MOS transistor and, for example, a bipolar transistor may alternatively be used for the purpose of the invention.

Any of the above described embodiments of current generating circuit comprises MOS transistors for receiving signals ACT, /ACT at the gate in order to reduce the consumed current when the circuit is not in operation. However, the present invention is also effective if the MOS transistors are replaced by bipolar transistors or if the MOS transistors are omitted. For example, if the consumed current is negligibly low when the chip is not in operation if compared with the overall consumed current of the chip in operation, it may be not necessary to provide MOS transistor for receiving signals ACT, /ACT at the gate.

FIGS. 39 through 47 show circuit diagrams of current generating circuits obtained by modifying the current generating circuit of FIG. 6.

In these figures, the elements corresponding to their counterparts of FIG. 6 are denoted respectively by the same reference symbols.

Figure 38:
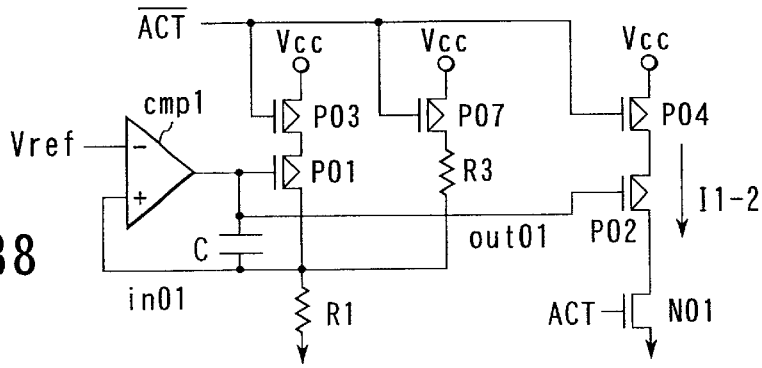
FIG. 38 is a schematic circuit diagram of still another embodiment of a current generating circuit according to the invention.

If compared with the circuit of FIG. 6, the circuit of FIG. 38 is characterized in that a capacitor C is additionally connected between the output terminal of the differential amplifier cmp1 and the positive side input terminal. The capacitor C takes the role of improving the responsiveness and the convergence of operation of the current generating circuit.

In this embodiment, the electric current I1-2 is expressed by the formula below:

$$I1\text{-}2=k3\times\{Vref/R1-(Vcc-Vref)/R3\}$$

where k3 is the current ratio of the MOS transistors P01, P02 whose gates are at a same potential level [=I(P02)/I(P01)] and hence can be set to a level not dependent on the supply potential.

Figure 39:
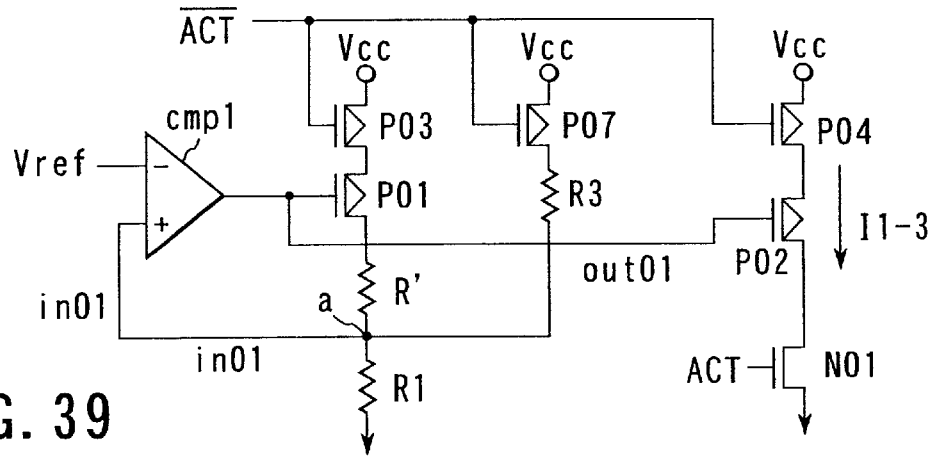
FIG. 39 is a schematic circuit diagram of still another embodiment of a current generating circuit according to the invention.

If compared with the circuit of FIG. 6, the circuit of FIG. 39 is characterized in that a resistor R' is additionally connected between the MOS transistor P01 and the node a. More specifically, the resistors R', R1 are connected in series between the MOS transistor P01 and the grounding terminal and the contact point (node a) of the resistors R', R1 is connected to the positive side input terminal of the differential amplifier cmp1.

In this embodiment, the electric current I1-3 is expressed by the formula below:

$$I1\text{-}3=k3\times\{Vref/R1-(Vcc-Vref)/R3\}$$

where k3 is the current ratio of the MOS transistors P01, P02 whose gates are at a same potential level [=I(P02)/I(P01)] and hence can be set to a level not dependent on the supply potential.

Note that the resistor R' may be replaced by some other element such as an MOS transistor or a diode.

Figure 40:
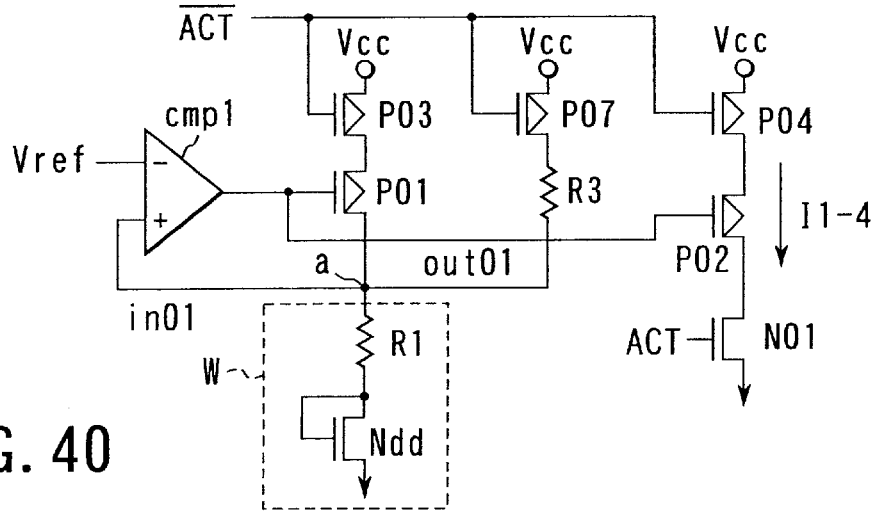
FIG. 40 is a schematic circuit diagram of still another embodiment of a current generating circuit according to the invention.

If compared with the circuit of FIG. 6, the circuit of FIG. 40 is characterized in that an N-channel MOS transistor Ndd having a diode connection (mutual connection of gate and drain) is additionally connected between the resistor R1 and the grounding terminal.

In this embodiment, the electric current I1-4 is expressed by the formula below:

$$I1\text{-}4=k3\times\{(Vref-Vthn)/R1-(Vcc-Vref)/R3\}$$

where k3 is the current ratio of the MOS transistors P01, P02 whose gates are at a same potential level [=I(P02)/I(P01)] and hence can be set to a level not dependent on the supply potential and Vthn is the threshold value of the N-channel MOS transistor Ndd.

Figure 41:
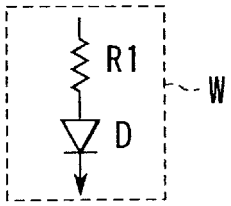
FIG. 41 is a schematic circuit diagram of a circuit obtained by modifying the portion of the circuit of FIG. 40 enclosed by broken lines in FIG. 40.
Figure 42:
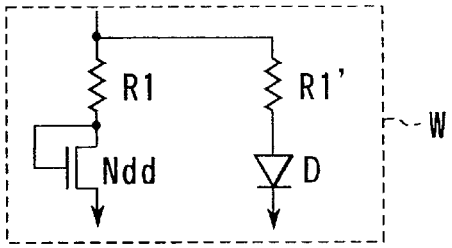
FIG. 42 is a schematic circuit diagram of another circuit obtained by modifying the portion of the circuit of FIG. 40 enclosed by broken lines in FIG. 40.

The circuits of FIGS. 41 and 42 are obtained by modifying the component circuit of FIG. 40 enclosed by broken lines. In the case of FIG. 41, a diode D is connected between the resistor R1 and the grounding terminal. The circuit of FIG. 42 is realized by combining the circuit of FIG. 40 and that of FIG. 41 and characterized in that it additionally comprises an MOS transistor Ndd, a diode D and a resistor R1'.

In these circuits, the electric currents I1-4' and I1-41" are expressed respectively by the formulas below:

$$I1\text{-}4'3\times\{(Vref-Vb)/R1-(Vcc-Vref)/R3\}$$

where k3 is the current ratio of the MOS transistors P01, P02 whose gates are at a same potential level [=I(P02)/I(P01)] and hence can be set to a level not dependent on the supply potential and Vb is the potential difference of the opposite ends of the diode, and $$I1\text{-}4''=k3\times\{(Vref-Vthn)/R1+(Vref-Vb)/R1'-(Vcc-Vref)/R3\}$$

where k3 is the current ratio of the MOS transistors P01, P02 whose gates are at a same potential level [=I(P02)/I(P01)] and hence can be set to a level not dependent on the supply potential and Vthn is the threshold value of the N-channel MOS transistor Ndd, whereas Vb is the potential difference of the opposite ends of the diode.

Figure 43:
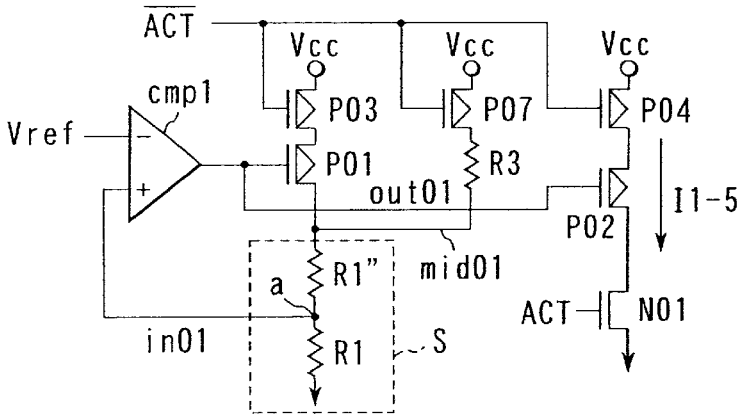
FIG. 43 is a schematic circuit diagram of a still another embodiment of current generating circuit according to the invention.

If compared with the circuit of FIG. 6, the circuit of FIG. 43 is characterized in that resistors R1, R1" are connected in series between the MOS transistor P01 and the grounding terminal and the contact point (node a) of the resistors R1, R1" is connected to the positive side input terminal of the differential amplifier cmp1, while a resistor R3 is connected to the connection node of the MOS transistor P01 and the resistor R1".

In this embodiment, the input potential in01 is controlled so as to be equal to the reference potential Vref so that mid01 is controlled so as to be equal to {Vref×(R1"+R1)/R1}.

Then, the electric current I1-5 is expressed by the formula below:

$$I1\text{-}5=k3\times\{Vref/R1-(Vcc-(Vref\times(R1''+R1)/R1))/R3\}$$

where k3 is the current ratio of the MOS transistors P01, P02 whose gates are at a same potential level [=I(P02)/I(P01)] and hence can be set to a level not dependent on the supply potential.

Figure 44:
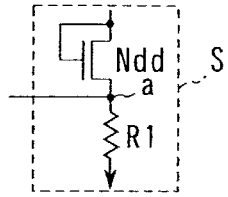
FIG. 44 is a schematic circuit diagram of a circuit obtained by modifying the portion of the circuit of FIG. 43 enclosed by broken lines in FIG. 43.
Figure 45:
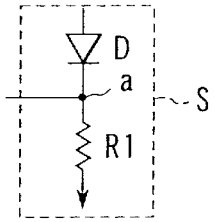
FIG. 45 is a schematic circuit diagram of another circuit obtained by modifying the portion of the circuit of FIG. 43 enclosed by broken lines in FIG. 43.

The circuits of FIGS. 44 and 45 are obtained by modifying the component circuit of FIG. 43 enclosed by broken lines. In the case of FIG. 44, the resistor R1" in the component circuit enclosed by broken lines in FIG. 43 is replaced by an N-channel MOS transistor Ndd having a diode connection (mutual connection of gate and drain). In the case of FIG. 45, on the other hand, the resistor R1" in the component circuit enclosed by broken lines in FIG. 43 is replaced by a diode D.

In these circuits, the electric currents I1-5' and I1-5" are expressed respectively by the formulas below:

$$I1\text{-}5''=k3\times\{Vref/R1-(Vcc-(Vref+Vthn))/R3\}$$

where k3 is the current ratio of the MOS transistors P01, P02 whose gates are at a same potential level [=I(P02)/I(P01)] and hence can be set to a level not dependent on the supply potential and Vthn is the threshold value of the N-channel MOS transistor Ndd, an $$I1\text{-}5''=k3\times\{Vref/R1-(Vcc+Vb)/R3\}$$

where k3 is the current ratio of the MOS transistors P01, P02 whose gates are at a same potential level [=I(P02)/I(P01)] and hence can be set to a level not dependent on the supply potential and Vb is the potential difference of the opposite ends of the diode.

Figure 46:
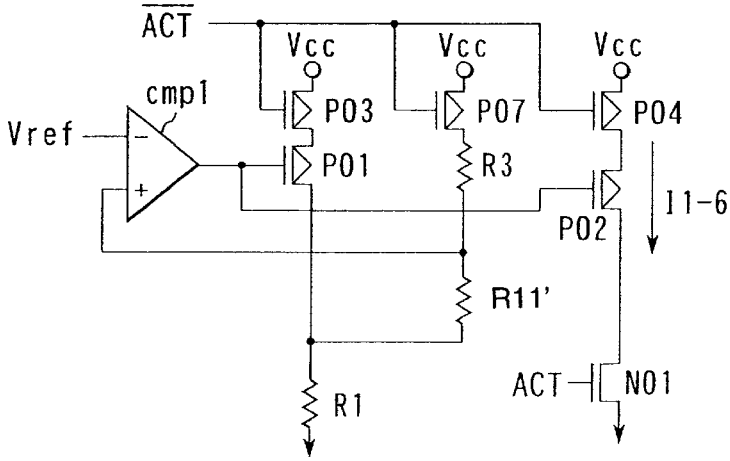
FIG. 46 is a schematic circuit diagram of still another embodiment of a current generating circuit according to the invention.

If compared with the circuit of FIG. 6, the circuit of FIG. 46 is characterized in that a resistor R11' is additionally connected between the resistors R1, R3 and the contact point of the resistors R3, R11' is connected to the positive side input terminal of the differential amplifier cmp1.

Then, the electric current I1-6 is expressed by the formula below:

$$I1\text{-}6=k3\times\{Vref/R1-(Vcc-Vref)\times(R11'/(R1\times R3)+1/R3\}$$

where k3 is the current ratio of the MOS transistors P01, P02 whose gates are at a same potential level [=I(P02)/I(P01)] and hence can be set to a level not dependent on the supply potential.

Figure 47:
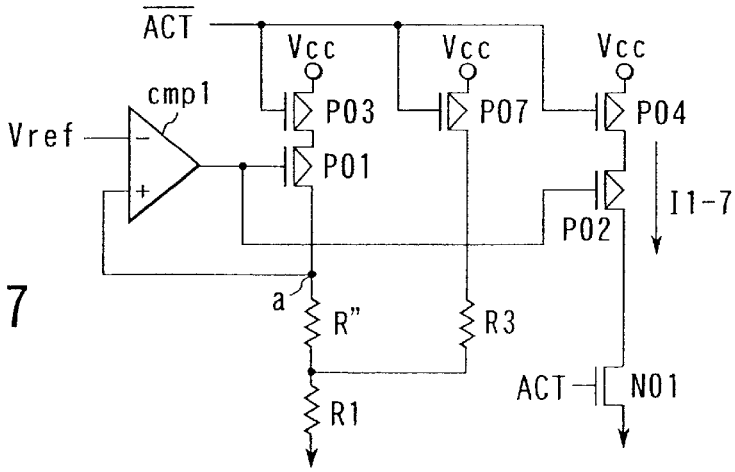
FIG. 47 is a schematic circuit diagram of still another embodiment of a current generating circuit according to the invention.

If compared with the circuit of FIG. 6, the circuit of FIG. 47 is characterized in that a resistor R" is additionally connected between the MOS transistor P01 and the resistor R1 and the contact point a of the MOS transistor P01 and the resistor R1 is connected to the positive side input terminal of the differential amplifier cmp1, while a resistor R3 is connected to the connection node of the resistors R1, R".

Then, the electric current I1-7 is expressed by the formula below:

$$I1\text{-}7=k3\times Vref/\{(Vcc\times(R1/R3-R1\times R1/(R3\times(R3+R1)))+R''+R1-R1\times R1/(R3+R1)\}$$

where k3 is the current ratio of the MOS transistors P01, P02 whose gates are at a same potential level [=I(P02)/I(P01)] and hence can be set to a level not dependent on the supply potential.

While circuits obtained by modifying the circuit of FIG. 6 are described above, the obtained circuits may further be modified and/or combined with an oscillator.

While the present invention is described in detail by referring to preferred embodiments of the invention, they may be modified in various different ways without departing from the scope of the invention.

Thus, a current generating circuit according to the invention can be made to show a variable dependency of the supply potential. Therefore, its operating characteristics can be made less dependent on the supply potential and used to operate the LSI that comprises it in a stable manner over a wide range of supply potential (fluctuations in the supply potential).

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A current generating circuit comprising:

a first transistor connected between a first supply terminal and a node directly or by way of another element;

a total of k first elements ($0 \leqq k \leqq n$ (where n is 0 or a natural number)) connected between said first supply terminal and said node directly or by way of another element;

a total of n−k second elements connected between said node and a second supply terminal directly or by way of another element;

a control circuit for setting a potential of said node to a predetermined level; and a second transistor having a source connected to said first supply terminal directly or by way of another element and a gate connected to a gate of said first transistor and adapted to generate a second current by using a first current flowing to said first transistor as a reference, the first current flowing to said first transistor showing a current value equal to the value obtained by subtracting the sum of currents flowing to the respective k first elements from the sum of currents flowing to the respective n−k second elements.

2. A current generating circuit according to claim 1, wherein a current flows to all of said first transistor, said k first elements and said n−k second elements when said current generating circuit is operated.

3. A current generating circuit according to claim 1, wherein both said k first elements and said n−k second elements comprise resistors or transistors.

4. A current generating circuit according to claim 1, wherein said control circuit comprises a differential amplifier adapted to compare the potential of said node and a reference potential and feed the gates of said first and second transistors with a control signal reflecting the outcome of the comparison.

5. A current generating circuit according to claim 1, wherein a supply potential is applied to said first supply terminal and a ground potential is applied to said second supply terminal.

6. A current generating circuit according to claim 1, wherein a ground potential is applied to said first supply terminal and a supply potential is applied to said second supply terminal.

7. A current generating circuit according to claim 5, wherein if the potential of said node is expressed by Vref and said supply potential is expressed by Vcc and if a, b and c are respectively first, second and third constants, said second transistor generates a current expressed by formula:

$$(a \times Vref)+[b \times \{Vcc-c \times (Vref)\}].$$

8. A current generating circuit according to claim 7, wherein said c has a value of 1.0.

9. A current generating circuit according to claim 6, wherein if the potential of said node is expressed by Vref and said supply potential is expressed by Vcc and if a, b and c are respectively first, second and third constants, said second transistor generates a current expressed by formula:

$$(a \times Vref)+[b \times \{Vcc-c \times (Vref)\}].$$

10. A current generating circuit according to claim 9, wherein said c has a value of 1.0.

11. A current generating circuit according to claim 5, wherein if a potential of said node is expressed by Vref, said supply potential is expressed by Vcc and the absolute value of a threshold value of a third transistor included in said k first elements or said n−k second elements is expressed by Vth and if a and b are respectively first and second constants, said second transistor generates a current expressed by formula:

$$(a \times Vref)+\{b \times (Vcc-Vth)\}.$$

12. A current generating circuit according to claim 6, wherein if a potential of said node is expressed by Vref, said supply potential is expressed by Vcc and the absolute value of a threshold value of a third transistor included in said k first elements or said n−k second elements is expressed by Vth and if a and b are respectively first and second constants, said second transistor generates a current is expressed by formula:

$$(a \times Vref)+\{b \times (Vcc-Vth)\}.$$

13. A current generating circuit according to claim 1, wherein an electric current flowing to said second transistor is used to control an oscillator.

14. A current generating circuit according to claim 13, wherein an output signal of said oscillator is used as a drive signal for a booster.

15. A current generating circuit comprising:

a first transistor connected between a first supply terminal and a node directly or by way of another element;

a first element connected between said first supply terminal and said node directly or by way of another element;

a second element connected between said node and a second supply terminal directly or by way of another element;

a control circuit for setting a potential of said node to a predetermined level; and a second transistor having a source connected to said first supply terminal directly or by way of another element and a gate connected to a gate of said first transistor and adapted to generate a second current by using a first current flowing to said first transistor as a reference, the first current flowing to said first transistor showing a current value equal to the value obtained by subtracting a current flowing to the first element from a current flowing to the second element.

16. A current generating circuit according to claim 15, wherein a supply potential is applied to said first supply terminal and a ground potential is applied to said second supply terminal.

17. A current generating circuit according to claim 15, wherein a ground potential is applied to said first supply terminal and a supply potential is applied to said second supply terminal.

18. A current generating circuit according to claim 16, wherein if the potential of said node is expressed by Vref and said supply potential is expressed by Vcc and if a, b and c are respectively first, second and third constants, said second transistor generates a current expressed by formula:

$$(a\times Vref)+[b\times\{Vcc-c\times(Vref)\}].$$

19. A current generating circuit according to claim 18, wherein said c has a value of 1.0.

20. A current generating circuit according to claim 17, wherein if the potential of said node is expressed by Vref and said supply potential is expressed by Vcc and if a, b and c are respectively first, second and third constants, said second transistor generates a current expressed by formula:

$$(a\times Vref)+[b\times\{Vcc-c\times(vref)\})].$$

21. A current generating circuit according to claim 20, wherein said c has a value of 1.0.

22. A current generating circuit according to claim 16, wherein if the potential of said node is expressed by Vref, said supply potential is expressed by Vcc and the absolute value of a threshold value of a third transistor included in said first element or said second element is expressed by Vth and if a and b are respectively first and second constants, said second transistor generates a current expressed by formula:

$$(a\times Vref)+\{b\times(Vcc-Vth)\}.$$

23. A current generating circuit according to claim 17, wherein if the potential of said node is expressed by Vref, said supply potential is expressed by Vcc and the absolute value of a threshold value of a third transistor included in said first element or said second element is expressed by Vth and if a and b are respectively first and second constants, said second transistor generates a current expressed by formula:

$$(a\times Vref)+\{b\times(Vcc-Vth)\}.$$

24. A current generating circuit according to claim 15, wherein an electric current flowing to said second transistor is used to control an oscillator.

25. A current generating circuit according to claim 24, wherein an output signal of said oscillator is used as a drive signal for a booster.

26. A current generating circuit comprising:

a first transistor connected between a first supply terminal and a node directly or by way of another element;

at least one transistor and at least one element other than a transistor connected between said node and a second supply terminal directly or by way of another element, a gate potential of said at least one transistor being different from a gate potential of said first transistor;

a control circuit for setting a potential of said node to a predetermined level; and a second transistor having a source connected to said first supply terminal directly or by way of another element and a gate connected to a gate of said first transistor and adapted to generate a second current by using a first current flowing to said first transistor as a reference, the first current flowing to said first transistor showing a current value equal to the sum of currents flowing respectively to said at least one transistor and said at least one element not a transistor.

27. A current generating circuit according to claim 26, wherein a supply potential is applied to said first supply terminal and a ground potential is applied to said second supply terminal.

28. A current generating circuit according to claim 26, wherein a ground potential is applied to said first supply terminal and a supply potential is applied to said second supply terminal.

29. A current generating circuit according to claim 27, wherein if the potential of said node is expressed by Vref and said supply potential is expressed by Vcc and if a, b and c are respectively first, second and third constants, said second transistor generates a current expressed by formula:

$$(a\times Vref)+[b\times\{Vcc-c\times(Vref)\}].$$

30. A current generating circuit according to claim 29, wherein said c has a value of 1.0.

31. A current generating circuit according to claim 28, wherein if the potential of said node is expressed by Vref and said supply potential is expressed by Vcc and if a, b and c are respectively first, second and third constants, said second transistor generates a current expressed by formula:

$$(a\times Vref)+[b\times\{Vcc-c\times(Vref)\}].$$

32. A current generating circuit according to claim 31, wherein said c has a value of 1.0.

33. A current generating circuit according to claim 27, wherein if the potential of said node is expressed by Vref, said supply potential is expressed by Vcc and the absolute value of a threshold value of a third transistor included in said at least one transistor is expressed by Vth and if a and b are respectively first and second constants, said second transistor generates a current expressed by formula:

$$(a\times Vref)+\{b\times(Vcc-Vth)\}.$$

34. A current generating circuit according to claim 28, wherein if the potential of said node is expressed by Vref, said supply potential is expressed by Vcc and the absolute value of a threshold value of a third transistor included in said at least one transistor is expressed by Vth and if a and b are respectively first and second constants, said second transistor generates a current expressed by formula:

$$(a\times Vref)+\{b\times(Vcc-Vth)\}.$$

35. A current generating circuit according to claim 26, wherein an electric current flowing to said second transistor is used to control an oscillator.

36. A current generating circuit according to claim 35, wherein an output signal of said oscillator is used as a drive signal for a booster.

37. A current generating circuit comprising:

a first transistor connected between a first supply terminal and a node directly or by way of another element;

a first element connected between said first supply terminal and said node directly or by way of another element;

a second element connected between said node and a second supply terminal directly or by way of another element;

a second transistor having a source connected to said first supply terminal directly or by way of another element and a gate connected to a gate of said first transistor and adapted to generate a second current by using a first current flowing to said first transistor as a reference; and a differential amplifier adapted to compare a potential of said node and a reference potential and applying a control signal reflecting the outcome of the comparison to the gate of said first transistor and a gate of said second transistor.

38. A current generating circuit according to claim 37, wherein a current flows to all of said first transistor, said second transistor, said first element and said second element when said current generating circuit is operated.

39. A current generating circuit according to claim 37, wherein both said first element and said second element comprise resistors or transistors.

40. A current generating circuit according to claim 37, wherein a supply potential is applied to said first supply terminal and a ground potential is applied to said second supply terminal.

41. A current generating circuit according to claim 37, wherein a ground potential is applied to said first supply terminal and a supply potential is applied to said second supply terminal.

42. A current generating circuit according to claim 40, wherein if said reference potential is expressed by Vref and said supply potential is expressed by Vcc and if a, b and c are respectively first, second and third constants, said second transistor generates a current expressed by formula:

$$(a\times Vref)+[b\times\{Vcc-c\times(Vref)\}].$$

43. A current generating circuit according to claim 42, wherein said c has a value of 1.0.

44. A current generating circuit according to claim 41, wherein if said reference potential is expressed by Vref and said supply potential is expressed by Vcc and if a, b and c are respectively first, second and third constants, said second transistor generates a current expressed by formula:

$$(a\times Vref)+[b\times\{Vcc-c\times(Vref)\}].$$

45. A current generating circuit according to claim 44, wherein said c has a value of 1.0.

46. A current generating circuit according to claim 40, wherein if said reference potential is expressed by Vref, said supply potential is expressed by Vcc and the absolute value of a threshold value of a third transistor included in said first element or said second element is expressed by Vth and if a and b are respectively first and second constants, said second transistor generates a current expressed by formula:

$$(a\times Vref)+\{b\times(Vcc-Vth)\}.$$

47. A current generating circuit according to claim 41, wherein if said reference potential is expressed by Vref, said supply potential is expressed by Vcc and the absolute value of a threshold value of a third transistor included in said first element or said second element is expressed by Vth and if a and b are respectively first and second constants, said second transistor generates a current expressed by formula:

$$(a\times Vref)+\{b\times(Vcc-Vth)\}.$$

48. A current generating circuit according to claim 37, wherein an electric current flowing to said second transistor is used to control an oscillator.

49. A current generating circuit according to claim 48, wherein an output signal of said oscillator is used as a drive signal for a booster.

50. A current generating circuit comprising:

a first transistor connected between a first supply terminal and a node directly or by way of another element;

a second transistor and a third transistor connected in parallel between said node and a second supply terminal, a gate potential of said second transistor being different from a gate potential of said first transistor and a gate potential of said third transistor being different from the gate potentials of said first and second transistors;

a control circuit for setting a potential of said node to a predetermined level; and a fourth transistor having a source connected to said first supply terminal directly or by way of another element and a gate connected to a gate of said first transistor and adapted to generate a second current by using a first current flowing to said first transistor as a reference, wherein a supply potential is applied to said first supply terminal and a ground potential is applied to said second supply terminal.

51. A current generating circuit according to claim 50, wherein an electric current flowing to said fourth transistor is used to control an oscillator.

52. A current generating circuit according to claim 51, wherein an output signal of said oscillator is used as a drive signal for a booster.

53. A current generating circuit comprising:

a first transistor connected between a first supply terminal and a node directly or by way of another element;

a second transistor and a third transistor connected between said node and a second supply terminal directly or by way of another element, a gate potential of said second transistor being different from a gate potential of said first transistor and a gate potential of said third transistor being different from the gate potentials of said first and second transistors;

a control circuit for setting a potential of said node to a predetermined level; and a fourth transistor having a source connected to said first supply terminal directly or by way of another element and a gate connected to a gate of said first transistor and adapted to generate a second current by using a first current flowing to said first transistor as a reference;

the gate potential of said third transistor is different from the gate potentials of said first and second transistors if the potential of said node is expressed by Vref and a supply potential is expressed by Vcc and if a, b, and c are respectively first, second, and third constants, said fourth transistor generates a current expressed by formula:

$$(a \times Vref)+(b \times \{Vcc-c \times (Vref)\}.$$

54. A current generating circuit according to claim 53, wherein the supply potential is applied to said first supply terminal and a ground potential is applied to said second supply terminal.

55. A current generating circuit according to claim 53, wherein said c has a value of 1.0.

56. A current generating circuit according to claim 54, wherein if the absolute value of a threshold value of a fifth transist or included in each of said second and third transistors is expressed by Vth, said second transistor generates a current expressed by formula:

$$(a \times Vref)+\{b \times (Vcc-Vth)\}.$$

57. A current generating circuit according to claim 53, wherein an electric current flowing to said fourth transistor is used to control an oscillator.

58. A current generating circuit according to claim 57, wherein an output signal of said oscillator is used as a drive signal for a booster.

* * * * *

UNITED STATES PATENT AND TRADEMARK OFFICE

CERTIFICATE OF CORRECTION

PATENT NO. : 6,297,688 B1
DATED : October 2, 2001
INVENTOR(S) : Hiroshi Nakamura It is certified that error appears in the above-identified patent and that said Letters Patent is hereby corrected as shown below:

Title page,
Item [56], References Cited, FOREIGN PATENT DOCUMENTS,
-- 0123456-A2 01/2000 EP -- has been inserted, Column 36,
Line 5, "transist or" has been replaced with -- transistor --.

Signed and Sealed this

Twenty-fourth Day of September, 2002

*Attest:*

*Attesting Officer*

JAMES E. ROGAN
*Director of the United States Patent and Trademark Office*